United States Patent [19]

Adachi et al.

[11] 4,214,500

[45] Jul. 29, 1980

[54] ELECTRONIC MUSICAL INSTRUMENTS

[75] Inventors: Takeshi Adachi, Hamamatsu; Eisaku Okamoto, Hamakita, both of Japan

[73] Assignee: Nippon Gakki Seizo Kabushiki Kaisha, Hamamatsu, Japan

[21] Appl. No.: 912,868

[22] Filed: Jun. 5, 1978

[30] Foreign Application Priority Data

Jun. 10, 1977 [JP] Japan ..... 52-67821
Sep. 24, 1977 [JP] Japan ..... 52-114983

[51] Int. Cl.[2] ..... G10H 1/02

[52] U.S. Cl. ..... 84/1.01; 84/1.03; 84/1.19; 84/1.24; 84/1.26; 84/1.27

[58] Field of Search ..... 84/1.01, 1.03, 1.11, 84/1.12, 1.19, 1.21, 1.24, 1.26, 1.27

[56] References Cited

U.S. PATENT DOCUMENTS

| | | | |
|---|---|---|---|
| 3,854,365 | 12/1974 | Tomisawa | 84/1.24 |
| 3,882,751 | 5/1975 | Tomisawa | 84/1.27 |
| 3,999,458 | 12/1976 | Suzuki | 84/1.24 |
| 4,050,343 | 9/1977 | Moog | 84/1.01 |
| 4,073,209 | 2/1978 | Whittington | 84/1.01 |
| 4,082,027 | 4/1978 | Hiyoshi | 84/1.24 |
| 4,114,497 | 9/1978 | Hiyoshi | 84/1.01 |
| 4,148,017 | 4/1979 | Tomisawa | 84/1.01 |

*Primary Examiner*—J. V. Truhe
*Assistant Examiner*—William L. Feeney
*Attorney, Agent, or Firm*—Charles E. Pfund

[57] ABSTRACT

The electronic musical instrument is provided with a plurality of musical tone generating channels of a number smaller than that of the keys and a channel processor for randomly assigning key information representing depressed keys to the musical tone generating channels. Furthermore the musical elements including the pitch, the tone color and the envelope of the musical tones generated by respective channels are made to be different thereby imparting a random property (casualness) to the generated musical tone.

11 Claims, 36 Drawing Figures

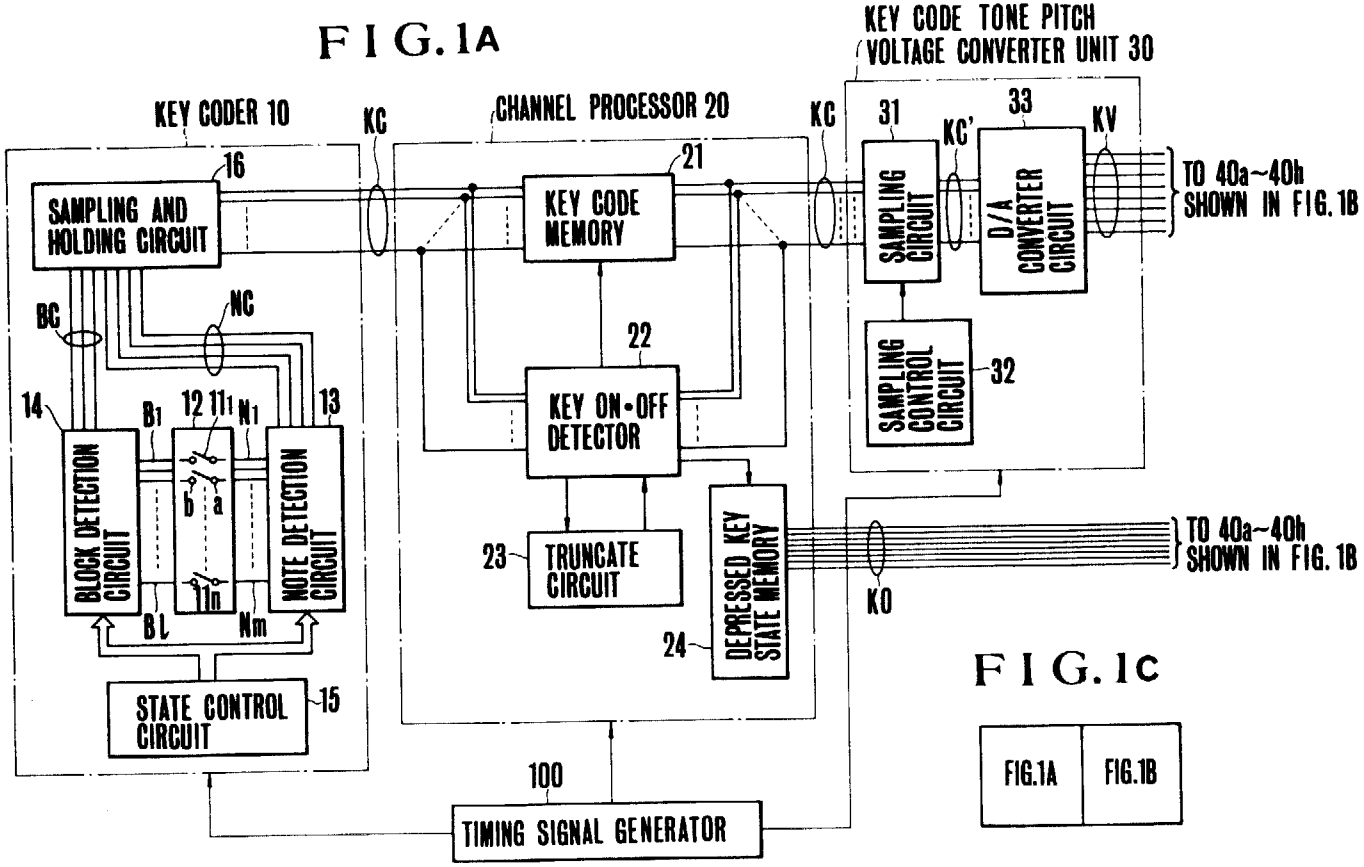
KEY CODE TONE PITCH VOLTAGE CONVERTER UNIT 30
TO 40a~40h SHOWN IN FIG. 1B
KV
D/A CONVERTER CIRCUIT
33
KC'
SAMPLING CIRCUIT
31
SAMPLING CONTROL CIRCUIT
32
KC
CHANNEL PROCESSOR 20
KEY CODE MEMORY
21
KEY ON-OFF DETECTOR
22
TRUNCATE CIRCUIT
23
DEPRESSED KEY STATE MEMORY
24
KO
TIMING SIGNAL GENERATOR
100
KEY CODER 10
SAMPLING AND HOLDING CIRCUIT
16
NOTE DETECTION CIRCUIT
13
BLOCK DETECTION CIRCUIT
14
STATE CONTROL CIRCUIT
15
NC
BC
FIG. 1A
FIG. 1B
FIG. 1C

| FIG. 5A | FIG. 5B |
|---|---|

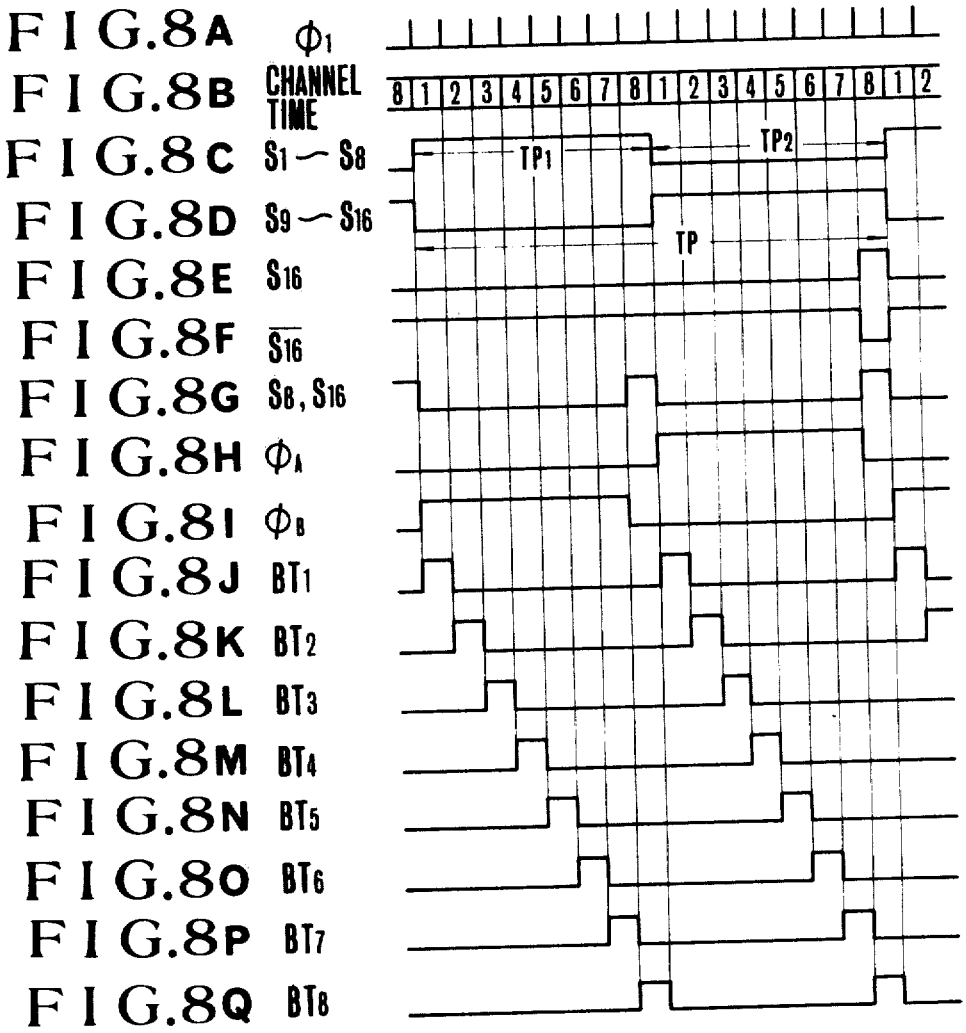
FIG.8A $\phi_1$
FIG.8B CHANNEL TIME
8 1 2 3 4 5 6 7 8 1 2 3 4 5 6 7 8 1 2
FIG.8C $S_1 \sim S_8$
TP1
TP2
FIG.8D $S_9 \sim S_{16}$
TP
FIG.8E $S_{16}$
FIG.8F $\overline{S_{16}}$
FIG.8G $S_8, S_{16}$
FIG.8H $\phi_A$
FIG.8I $\phi_B$
FIG.8J $BT_1$
FIG.8K $BT_2$
FIG.8L $BT_3$
FIG.8M $BT_4$
FIG.8N $BT_5$
FIG.8O $BT_6$
FIG.8P $BT_7$
FIG.8Q $BT_8$

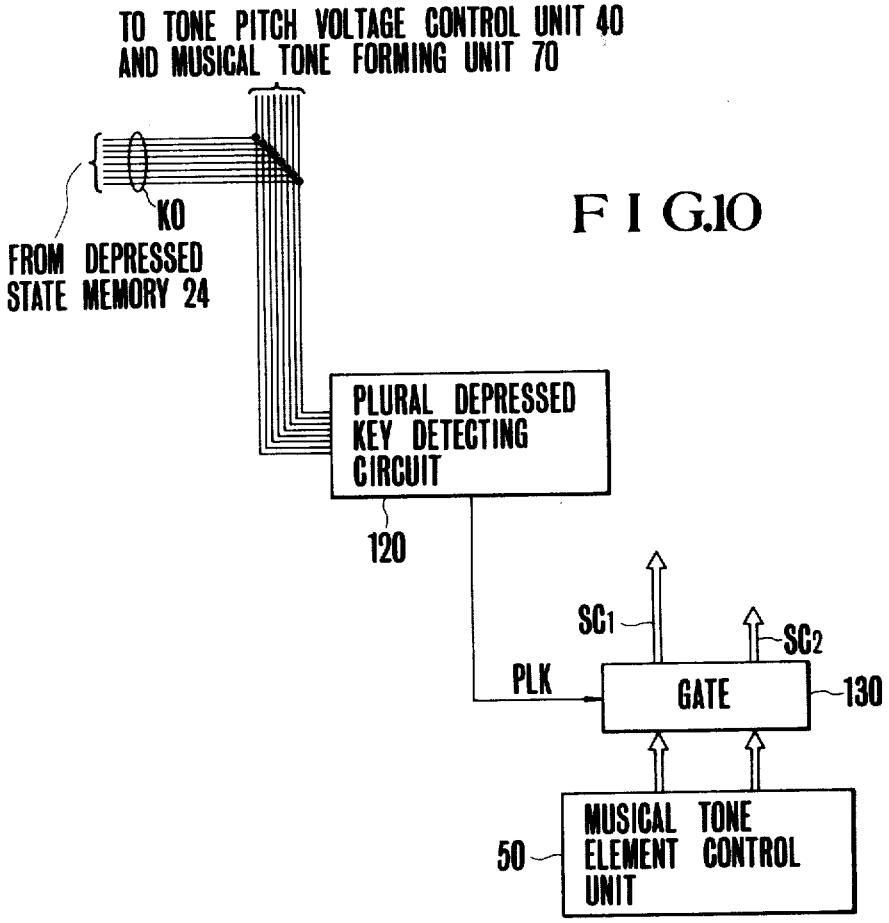
F I G.10
F I G.13
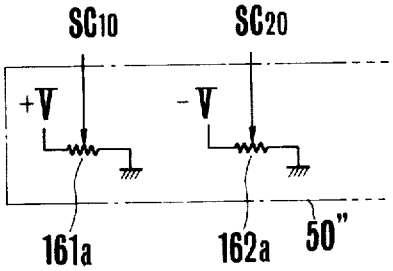

ELECTRONIC MUSICAL INSTRUMENTS

BACKGROUND OF THE INVENTION

This invention relates to an electronic musical instrument capable of producing musically rich performance tones by imparting random characteristics or casualness to the pitch, color and volume envelope to the musical tones generated by the musical instrument.

In an electronic musical instrument, the pitch of the generated musical tone and the generation of the tone are generally controlled by key informations which are generated in accordance with the depressed keys of a keyboard. The pitch variation, the tone color and the volume envelope of the generated musical tone are set and controlled by various operating means, for example a pitch adjusting lever, a tone adjusting lever, etc, which are mounted on a panel of the musical instrument. However, since these operating levers are mounted on the panel of the musical instrument the player can not operate them freely during performance, and usually the player must operate them before the performance. Accordingly, during the performance the musical tones are generated always under the same conditions, (that is the same pitch variation, the same tone color and the same volume envelope) with the result that the generated musical tones lack variety, thus producing extremely monotoneous tones.

SUMMARY OF THE INVENTION

It is an object of this invention to provide an improved electronic musical instrument capable of preventing generation of monotoneous musical tones but instead producing musically rich tones.

Another object of this invention is to provide an improved musical instrument capable of preventing generation of monotoneous musical tones in a case of generating plural tones thus producing musically rich tones.

According to this invention, there is provided an electronic musical instrument of the type comprising a keyboard having a plurality of keys; a plurality of musical tone generating channels each for producing a musical tone having a pitch, tone color and envelope elements, the number of the channels being lesser than that of the keys; a key coder circuit for generating key codes that identify depressed keys of the keyboard, a channel assigner circuit responsive to each of the key codes for generating a pitch designating signal and a tone generation timing signal and assigning each pair of these signals to each of the channels ready for receiving them; and means for generating a first signal that designates the pitch of the musical tone to be generated, and a second signal that determines the timing of the tone generation, characterized by a musical tone element control means which produces a modifying signal which modifies at least one of the pitch, tone color and envelope of the musical tone generated by each channel.

According to a preferred embodiment of this invention the first signal comprises a numerical signal proportional to a frequency and the channels are operated on a time sharing basis, and the electronic musical instrument is further provided with an accumulator that accumulates the numerical signal and a waveform memory circuit connected to receive the output of the accumulator for storing an amplitude value corresponding to a phase angle of the waveform of the musical tone, the phase angle being designated by the output of the accumulator, the accumulator producing an envelope waveform in accordance with the second signal that determines the timing of generating the musical tone, the envelope waveform modulating the amplitude value of the waveform memory to be read out in response thereto, and the modifying signal modifying the numerical signal.

According to a modification of this invention, each one of the musical tone generating channels comprises two sets of tone generating circuits for simultaneously generating the same key information by different tone forming circuits, and the musical tone element control signal is made to be different for respective tone generating channels.

BRIEF DESCRIPTION OF THE DRAWINGS

Further objects and advantages of the invention can be more fully understood from the following detailed description taken in conjunction with the accompanying drawings in which:

FIGS. 1A and 1B, when combined as shown in FIG. 1C, show a block diagram showing one embodiment of the electronic musical instrument embodying the invention;

FIGS. 8A through 8Q show waveforms useful to explain the operation of various elements of various circuits shown in FIGS. 1 through 7;

FIG. 10 is a block diagram showing a modified embodiment of this invention;

FIG. 13 is a connection diagram showing a modification of the musical tone element control signal generating element utilized in the musical tone element control unit.

DESCRIPTION OF THE PREFERRED EMBODIMENTS

A. Outline of the General Construction and Operation

Figure 1B:
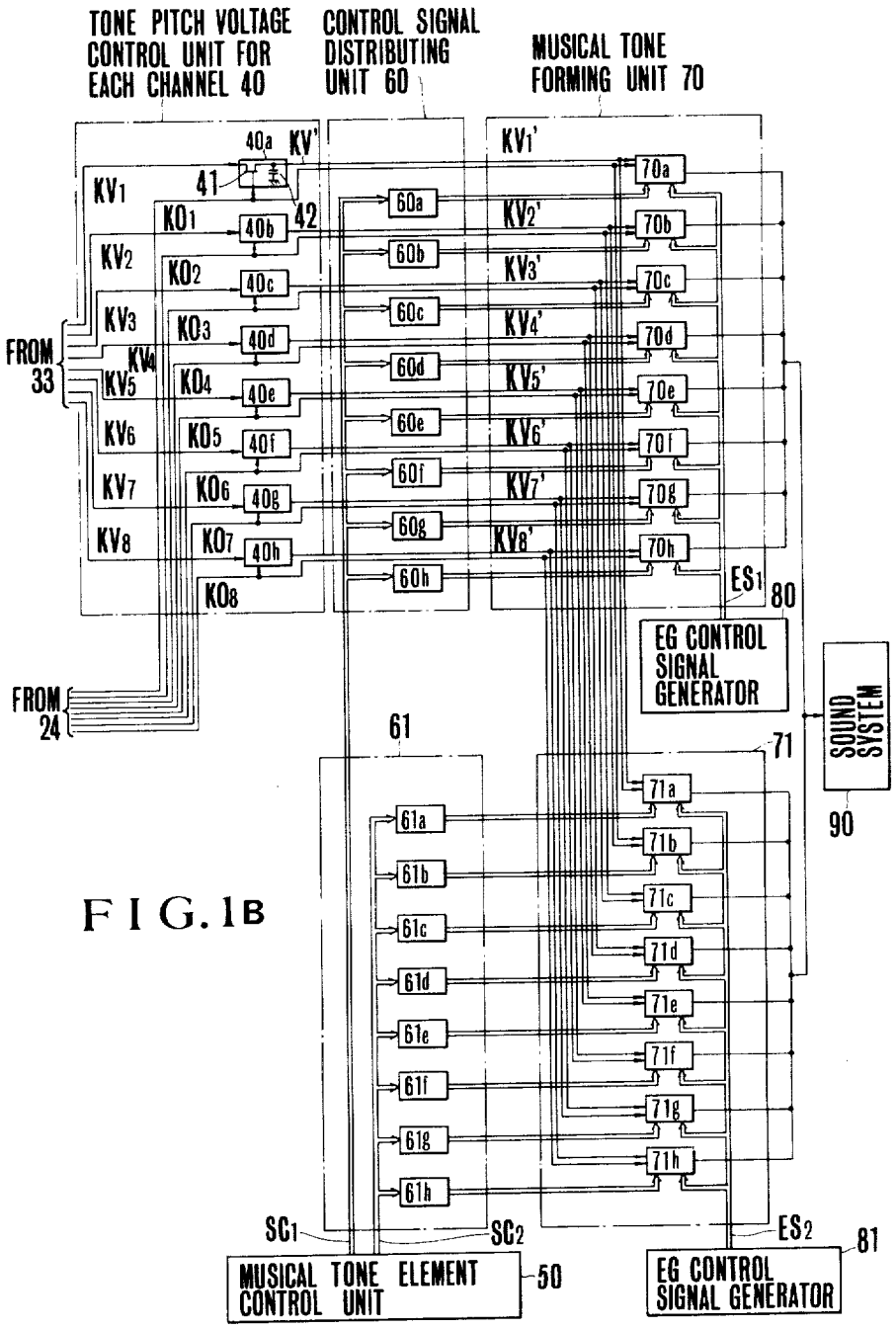

A preferred embodiment of the electronic musical instrument of this invention shown in FIGS. 1A and 1B comprises a key coder 10 which detects key switches operated by depressed keys (when the key switch is of the make contact type, it is closed when the associated key is depressed, whereas when the key switch is of the break contact type it is opened when the associated key is depressed) and produces key codes, that is encoded informations representing the depressed key switches; a channel processor 20 which assigns the key codes supplied from the key coder 10 to some of the tone generating channels (the number of which is much smaller than the number of keys) that can generate the tones at the same time; a key code-tone pitch voltage converter unit 30 which generates tone pitch voltages corresponding to the key codes KC supplied through the channel processor 20; a tone pitch voltage control unit 40 for each channel responsive to the operation of the key switches corresponding to the key codes KC assigned to respective channels by the channel processor 20; a musical tone element control unit 50 for producing two types of the musical tone element control signals; two groups of control signal distributing units 60 and 61 for distributing the musical tone element control signals from the musical tone element control unit 50 among musical tone forming circuits 70*a* through 70*h* (corresponding to respective tone generating channels) of two groups of musical tone forming units 70 and 71 which generate musical tone signals having tone pitches corresponding to respective tone pitch voltages supplied from respective channels of the tone pitch voltage control unit 40 and supply the generated musical tone signals to respective channels; envelope waveform (EG) control signal generators 80 and 81 for supplying various control signals utilized to form envelope waveforms to the musical tone forming units 70 and 71 for varying with time the pitch, color and volume of the musical tones formed; a sound system 90 for generating the musical tone signals from the musical tone forming units 70 and 71 as the performance tones, and a timing signal generator 100 which supplies timing signals to the units 10, 20 and 30 for controlling the operation thereof.

The constructions and operations of the respective units will now be described as follows.

Key coder 10

The key coder 10 is provided with a key switch circuit 12 having a number of key switches $\mathbf{11}_1$ through $\mathbf{11}_n$ which are grouped into a plurality of blocks, one for each octave, for example. The key switches of each block are assigned to a plurality of notes (for example 12 notes of C, C#, D . . . B). One terminals a (movable contacts) of respective key switches $\mathbf{11}_1$ through $\mathbf{11}_n$ are connected together for the same note of respective blocks and wiring lines $N_1$ through $N_m$ are connected to respective notes, whereas the other terminals b are commonly connected to wiring lines $B_1$ through $B_l$ for respective blocks. Consequently, the key switches $\mathbf{11}_1$ through $\mathbf{11}_n$ are connected across the column and row lines at respective cross points of a matrix circuit utilizing the block wiring lines $B_1$ through $B_l$ as the row lines and the note wiring lines $N_1$ through $N_m$ as the column lines. For this reason, the total number of the wiring lines derived out from the key switch circuit 12, that is the sum of the block wiring lines $B_1$ through $B_l$ and the note wiring lines $N_1$ through $N_m$ is much smaller than the total number of the key switches $\mathbf{11}_1$ through $\mathbf{11}_n$. For example, where the total number of key switches $\mathbf{11}_1$ through $\mathbf{11}_n$ is $n(|1\times m|)$ the total number of the wiring lines drawn out from the key switch circuit 12 is equal to the number of notes m + the number of blocks l, that is (m+l). The respective key switches $\mathbf{11}_1$ through $\mathbf{11}_n$ of the key circuit 12 are connected to a note detection circuit 13 through the note wiring lines $N_1$ through $N_m$ and to a block detection circuit 14 through block wiring lines $B_1$ through $B_l$.

Detection of the operated key switches among the key switches $\mathbf{11}_1$ through $\mathbf{11}_n$ is performed by sequentially detecting several types of the operation states. A first state $ST_1$ is memorized by applying a signal to the movable contacts a of all key switches $\mathbf{11}_1$ through $\mathbf{11}_n$ from the note detection circuit 13 via the note wiring lines $N_1$ through $N_m$ for applying the signal to the block wiring lines $B_1$ through $B_l$ of a specific block to which the operated key switches belong via the stationary contacts b of only the operated key switches and then supplying the signal on the block wiring lines $B_1$ through $B_1$ to the block detection circuit 14 whereby one or more operated key switches belonging to a specific block or blocks are detected. The memory timing of the block detection circuit 14 during the first state is determined by a first state signal supplied from a state control circuit 15 which operates in synchronism with the timing signal generator 100. When the memory operation of the block detection circuit 14 is completed, the state control circuit 15 detects this and starts the control of a second state.

During the second state $ST_2$, one of the blocks which have been stored in the block detection circuit 14 is extracted according to a predetermined order of preference for applying a signal to the stationary contact b of the key switches belonging to the extracted block via the block wiring lines $B_1$ through $B_l$ corresponding to the block extracted from the block detection circuit 14, thereby deriving out the signal through the note wiring lines $N_1$ through $N_m$ connected to the movable contacts of the key switches belonging to the extracted block. The signal thus derived out is stored in the note detection circuit 13. With this circuit construction, the signal from the block detection circuit 14 is transmitted to only the note wiring wires $N_1$ through $N_m$ corresponding to the operated key switches $\mathbf{11}_1$ through $\mathbf{11}_n$, and stored in the note detection circuit 13 thus detecting the note of the operated key switch or switches in the extracted block. The signal of the block extracted from the block detection circuit 14 is converted into a block code signal (hereinafter called block code BC) representing said block and consisting of a plurality of bits (in this example 3) and the block code BC is supplied to and stored by a sampling and holding circuit 16. Just in the same manner as the first state, the timing of extracting one block from the block detection circuit 14 and the storing timing of the note detection circuit 13 during the second state are determined by a second state signal supplied from a state control circuit 15. When the memory operation of the note detection circuit 13 completes, the state control circuit 15 detects this and starts the control of a third state.

During the third state $ST_3$ which follows the second state $ST_2$, one or more notes which have been stored in the note detection circuit 13 during the second state are sequentially extracted according to a predetermined order of preference and in synchronism with the system clock, and a signal regarding the extracted note is converted into a note code signal (hereinafter called note code NC) representing said extracted note and consisting of a plurality of bits (in this example 4). The note codes NC are sequentially supplied to the sampling and holding circuit 16. Since the third state $ST_3$ is executed with respect to specific notes stored in the note detection circuit 13 there is no time loss. Suppose now that three types of notes have been stored in the note detection circuit 13, the third state regarding a specific block is completed at the third clock time of the system clock. When all note codes NC in the note detection circuit 13 have been read out the state control circuit 15 detects this to begin the control of the next state. Where there are memories of the block signals still remaining in the block detection circuit 14 the controls of the second and third states are resumed thereby executing these states as above described. Where there is no memory of the block signal remaining in the block detection circuit 14 the electric charges (stored in the stray capacitances of the wiring wires and in small capacitors connected thereto) remaining in the block wiring wires $B_1$ through $B_l$ of the key switch circuit 12 are discharged and then the first state is resumed again.

During the third state $ST_3$, the sampling and holding circuit 16 holds the memory of the block code BC which was supplied from the block detection circuit 14 during the second state $ST_2$ and produces the block code BC in synchronism with the note code NC supplied from the note detection circuit 13. Consequently the sampling and holding circuit 16 produces a 7 bit key code KC which is formed by combining a block code BC and a note code NC. The key code KC makes ready descrimination of the operated key switches.

As above described, until the detection of all operated key switches is completed, the first to third states $ST_1$, $ST_2$ and $ST_3$ are sequentially executed, but when the block codes regarding all blocks and firstly stored in the block detection circuit 14 have been sent out and when the note codes NC regarding the notes of the operated key switches belonging to the last block have already been extracted there is no memory remaining in the block detection circuit 14 and the note detection circuit 13 whereby the state is transferred to a fourth state $ST_0$, that is a waiting state. When the fact that the operations of the key switch circuit 12, the note detection circuit 12, and the note detection circuit 13 and the block detection circuit 14 have been reset is confirmed the state is returned again to the first state $ST_1$ and thereafter the state is advanced to the fourth or waiting state $ST_0$ through the second and third states $ST_2$ and $ST_3$ thus repeating the detection operation of all key switches.

The key code KC produced by the sampling and holding circuit 16 of the key coder 10 is applied to the channel processor 20 where channels for forming the musical tone signals are assigned to the key code. At this time, the key code KC sent from the sampling and holding circuit 16 is held for a definite interval which corresponds to the interval in which one assigning process is executed by the channel processor 20.

Each time a fourth state is set when all signals of the operated key switches have been converted into corresponding key codes and sent out, the key coder 10 sends out a start signal X via the sampling and holding circuit 16. The signal X is used by the channel processor 20 to detect a key release.

One example of the contents of the block code BC and the note code NC of the key code KC sent from the key coder 10 is shown in Table 1 below.

Table 1

| block note | | key code KC | | | | | | |
|---|---|---|---|---|---|---|---|---|
| | | block code BC | | | note code NC | | | |
| | | $KB_3$ | $KB_2$ | $KB_1$ | $KN_4$ | $KN_3$ | $KN_2$ | $KN_1$ |
| block | first | 0 | 0 | 1 | | | | |
| (octave | second | 0 | 1 | 0 | | | | |

Table 1-continued

| block note | | key code KC | | | | | | |
|---|---|---|---|---|---|---|---|---|
| | | block code BC | | | note code NC | | | |
| | | $KB_3$ | $KB_2$ | $KB_1$ | $KN_4$ | $KN_3$ | $KN_2$ | $KN_1$ |
| tone | third | 0 | 1 | 1 | | | | |
| range) | fourth | 1 | 0 | 0 | | | | |
| | fifth | 1 | 0 | 1 | | | | |
| | C# | | | | 0 | 0 | 0 | 0 |
| | D | | | | 0 | 0 | 0 | 1 |
| | D# | | | | 0 | 0 | 1 | 0 |
| | E | | | | 0 | 1 | 0 | 0 |
| | F | | | | 0 | 1 | 0 | 1 |
| | F# | | | | 0 | 1 | 1 | 0 |
| | G | | | | 1 | 0 | 0 | 0 |
| | G# | | | | 1 | 0 | 0 | 1 |
| | A | | | | 1 | 0 | 1 | 0 |
| | A# | | | | 1 | 1 | 0 | 0 |
| | B | | | | 1 | 1 | 0 | 1 |
| | C | | | | 1 | 1 | 1 | 0 |

Channel Processor 20

The channel processor 20 is constituted by a key coder memory circuit 21, a key ON.OFF detector 22, a truncate circuit 23 and a depressed key state memory circuit 24.

The key code memory circuit 21 is provided with a plurality of memory circuits of the number corresponding to the number of channels that can generate tones at the same time. It is advantages to form the memory circuits with circulating shift registers. Denoting the number of the channels by A, and the number of bits of the key code KC by B, shift registers each having A stages with B memory units (one stage = B bits) are used so as to sequentially shift the stored (or already assigned) key code KC by the clock pulse thereby sending out the key codes on a time sharing basis which are used as the control signals for generating the musical tone waveforms. The sent out key codes are also fed back to the input side of the shift register to be circulated therethrough.

The key ON.OFF detector 22 functions to compare the input key code KC supplied from the key coder 10 and all key codes KC which are sequentially sent out from the key code memory circuit 21 on the time sharing basis. When these two inputs coincide with each other, the storing of the input key code KC in the key code memory circuit 21, that is the designation of the channels, is stopped by judging that a key code KC which is the same as the input key code has already been assigned to a given channel. On the other hand, non-coincidence of the result of comparison shows that there is a newly depressed key so that the input key code KC is stored in an idle channel (or a channel not restricted to generate a tone) of the key code memory circuit 21 which is designated by the truncate circuit 23 in a manner to be discribed later. The truncate circuit 23 detects a channel which is idle for the longest time of the key code memory circuit 21 so as to store the input key code KC in the key code memory circuit 21. When all channels are assigned with the key codes KC, the truncate circuit 23 detects a channel which is assigned to a tone whose associated key has already been released and has attenuated mostly so as to rewrite the key code KC which has been stored in the channel with the input key code KC.

The key ON.OFF detector 22 supplies and stores the state of assignment of the input key code to respective channels to the depressed key state memory circuit 24.

The signals read out from the key ON.OFF detector 22 are used to control the gate circuits of the tone pitch voltage control units 40 of respective channels and of the control circuits 40a through 40h and to control the tone forming operations of respective channels (tone forming circuits 70a–70h, and 71a–71h) of the musical tone forming units 70 and 71. The signals read out from the key ON.OFF detector 22 are also used to change the memory contents of the depressed key state memory circuit 24 by detecting released keys thereby terminating the generation of tones of the channels under predetermined conditions, for example gradual attenuation. An idle channel is selected in accordance with the contents stored in the depressed key state memory circuit 24 and the input key code KC is stored in a stage of the corresponding channel of the key code memory circuit 21. The key code memory circuit 21 and the depressed key state memory circuits 24 are constructed such that their stages corresponding to respective channels are selected synchronously and on the time sharing basis so as to store the signals. The channel processor 20 is controlled by the clock pulse generator 100 for controlling assignment of the input key code KC depending upon two fundamental conditions of (A) whether is there any idle channel (the channel not storing the key code) or not, and (B) whether the input key code KC has already been assigned to a given channel or not (that is the input key code KC has already been stored). For this reason, the channel to be assigned with the input key code KC is determined by the previous performance state and the state of assignment based on such performance, and which one of the channels is to be assigned is not specified. For this reason, the assigning operation of the channel processor 20 is irregular, that is random.

Key Code-Tone Pitch Voltage Convertor Unit 30

The key code-tone pitch voltage converter unit 30 comprises a sampling circuit 31, a sampling control circuit 32 for controlling the sampling period, and a digital-analogue (D/A) converter circuit 33, and operates to sample the key code KC supplied from the channel processor 20 by the sampling circuit 31 and to apply the sampled key code KC to the digital-analogue converter circuit 33. The sampling period of the sampling circuit 31 is determined by the output of the sampling control circuit 32 and the sampling period is equal to an interval required to count a number of clock pulses used to shift the content of the key code memory circuit 21 and is larger by one than the number of channels. Consequently, each time the content of the key code memory circuit 21 is circulated once, the sampling circuit 31 sequentially sample the key codes corresponding to different channels and continues to produce the sampled key code until the next sampling time thereby effecting a low speed sampling. Although the key coder 10 and the channel processor 20 are required to promptly detect the states (depressed and released states) of the key switches and to promptly assign the detected state to the channels, the elements processing the tone pitch voltage are connected in parallel so that these elements are not required to operate at high speeds. Moreover, because the analogue tone pitch voltage signals can not be processed at high speeds. More particularly, due to small electrostatic capacitances of the circuit system and of the wiring system the waveform of the signal is distorted with the result that it is impossible to produce accurate musical tones matched with the key code KC. For the reasons described above, the key code KC is sampled at a reduced speed and then the sampled key code KC is converted into an analogue signal for producing a tone pitch voltage KV which is supplied to the musical tone forming circuits 70a–70h and 71a–71h corresponding to respective channels. The digital-analogue converter circuit 33 connected to the output side of the sampling circuit 31 converts the key code KC into a corresponding tone pitch voltage KV. As above described, the analogue-digital converter circuit 33 is supplied with the key code KC which has been sampled at a reduced speed by the sampling circuit 31 and divides the key code into a block code BC and a note code NC which are decoded independently. In response to the decoded block code BC, a voltage signal corresponding to the block is produced by a potentiometer circuit and the voltage signal is further divided by the decoded output corresponding to the note thereby producing a tone pitch voltage KV corresponding to the key code. The tone pitch voltage KV is statically distributed among the same channels as those which have been assigned with the key codes KC respectively sampled by the sampling circuit 31 in response to the control signal supplied from the sampling control circuit 32. The distribution of the tone pitch voltage KV among respective channels is effected in synchronism with the operation of the depressed key state memory circuit 24 and in coincidence with the selection of the channels.

Tone Pitch Voltage Control Unit 40 for each Channel

This control unit 40 comprises tone pitch voltage control circuits 40a through 40h which are independently provided for respective channels. The tone pitch voltage control circuits 40a through 40h are connected to receive the tone pitch voltages KV ($KV_1$–$KV_8$) of respective channels which are supplied from the digital-analogue converter circuit 33. Each tone pitch voltage control circuit is constructed to store the tone pitch voltage in a capacitor 42 by opening a gate circuit 41 by a key ON signal KO supplied from the depressed key state memory circuit 24. Said gate circuit is constituted by such switching element as a field effect transistor. The terminal voltages of the capacitors 42 are supplied to the musical tone forming circuits 70a–70h and 71a–71h of the musical tone forming units 70 and 71 to act as the tone pitch voltage KV' ($KV'_1$–$KV'_8$).

Musical Tone Element Control Unit 50

The musical tone element control unit 50 produces musical element control signals utilized to control the characteristics of voltage controlled type variable frequency oscillators (VCO), high pass and low pass voltage controlled type variable filters (HPVCF and LPVCF) and voltage controlled type variable gain amplifiers (VCA) which are provided for respective musical tone forming circuits 70a–70h and 71a–71h of the musical tone forming units 70 and 71 as will be described later. The musical tone element control unit 50 is provided with a plurality of operating members or levers for setting the control signals in accordance with said VCO, VCF and VCA. So as to produce first (positive) and second (negative) musical element control signals $SC_1$ and $SC_2$ which are set by the operating levers. The positive first musical tone element control signal $SC_1$ is applied to the first control signal distributing unit 60, while the negative second musical tone element control signal $SC_2$ is supplied to the second control signal distributing unit 61.

Control Signal Distributing Units 60 and 61

These control units 60 and 61 comprise set circuits 60a–60h and 61a–61h respectively provided for different channels for setting control quantities and by suitably setting these set circuits the musical tone element control signals $SC_1$ and $SC_2$ supplied to the musical tone forming circuits 70a–70h and 71a–71h of respective channels can be variably set for respective channels. Thus, the musical tone element control unit 50 and the control signal distributing units 60 and 61 constitute means for controlling the musical tone elements of the musical tones to be generated.

Musical Tone Forming Units 70 and 71

The musical tone forming units 70 and 71 comprise musical tone forming circuits 70a–70h and 71a–71h respectively corresponding to respective channels. The musical tone forming circuits 70a–70h and 71a–71h are connected to parallelly receive the tone pitch voltages $KV'_1$–$KV'_8$ from the tone pitch control circuits 40a–40h of the tone pitch voltage control unit 40 of respective channels so as to form musical tone signals having tone pitches respectively corresponding to the tone pitch voltages $KV'_1$ through $KV'_8$. At this time, since the musical tone forming circuits 70a through 70h are commonly supplied with an envelope waveform control signal $ES_1$ from the first envelope waveform control signal generator 80 so that the pitch, color and volume of the musical tone signals formed by the musical tone forming circuits 70a through 70h are varied with time in accordance with the envelope waveform set by the control signal. Furthermore, an envelope waveform control signal $ES_2$ from the second envelope waveform control signal generator 81 is commonly supplied to the musical tone forming circuits 71a through 71h so that the pitch, color and volume of the generated musical signals are changed with time in the same manner as above described. At least one of the musical elements of the pitch, color and volume of the generated musical tone is set in each of the musical tone forming circuits 70a–70h and 71a–71h by the first and second musical element control signals $SC_1$ and $SC_2$ which are supplied by corresponding control quantity set circuits 60a–60h and 61a–61h.

In this manner, the musical tone forming circuits 70a–70h and 71a–71h generate musical tone signals which are different in each group and in each tone generating channel.

Timing Signal Generator 100

The timing signal generator 100 is constructed to count a reference clock signal supplied from a reference oscillator, not shown, to form various timing signals and to supply these timing signals to various units 10, 20 and 30 described above for synchronously controlling the operations thereof.

The Operation of the Embodiment Shown in FIGS. 1A and 1B

The electronic musical instrument described above operates as follows. When some of the keys of the keyboard are depressed to close corresponding ones of the key switches $11_1$–$11_n$, the key coder 10 generates key codes KC corresponding to the depressed keys which are supplied to the channel processor 20. In cooperation with the key ON·OFF detector 22 and the truncate circuit 23, the channel processor 20 selects one of idle channels or a channel in which the truncate has been mostly proceeded so as to store the key code KC in an address of the key code memory circuit 21 corresponding to the selected channel. The key ON·OFF detector 22 stores the key ON signal KO in an address of the depressed key state memory circuit 24 corresponding to the selected channel. The depressed key state memory circuit 24 supplies key ON signals $KO_1$–$KO_8$ to the tone pitch voltage control circuits 40a through 40h of the tone generating channel corresponding to the address in which the depressed key state has been stored.

The key code-tone pitch voltage converter 30 samples at a reduced speed by the sampling circuit 31 the key code KC sent from the key code memory circuit 21 in accordance with the output of the sampling control circuir 23 so as to supply the sampled key code signal KC' to the digital-analogue converter 33 which converts the key code signal KC' into a corresponding tone pitch voltage KV which is supplied to one of the tone pitch voltage control circuits 40a through 40h corresponding to a channel. In the tone pitch voltage control circuits 40a through 40h the gate circuits 41 are enabled by the key ON signals $KO_1$ through $KO_8$ independently supplied to respective channels so as to store the tone pitch voltages $KV_1$ through $KV_8$ independently supplied to the channels from the digital-analogue converter 33 in capacitors 42. The tone pitch voltages $KV'_1$ through $KV'_8$ stored and held in the capacitors 42 are supplied in parallel to the musical tone forming circuits 70a–70h and 71a through 71h of the two groups of the musical tone forming units 70 and 71.

The musical tone element control unit 50 is constructed to apply a first positive musical tone element control signal $SC_1$ set by a control member, not shown. to respective set circuits 60a through 60h of the control signal distributing unit 60 and to apply a second negative musical tone element control signal $SC_2$ to respective set circuits 60a through 61h of the control signal distributing unit 61. Accordingly, by setting the set circuits 60a–60h and 61a–61h at different conditions, it is possible to apply musical tone element control signals $SC_1$ and $SC_2$ corresponding to the setting of these set circuits to the musical tone forming circuits 70a–70h and 71a–71h of the musical tone forming units 70 and 71, so as to cause the musical tone forming circuits 70a–70h and 71a–71h to form musical tones having different characteristics.

The musical tones thus formed are then synthesized and produced as a performance tone through and sound system 90 including an expression circuit, an amplifier and a loudspeaker, not shown.

In the electronic musical instrument described above, since respective tone generating channels have different characteristics, that is since musical tone forming circuits 70a–70h and 71a–71h have different musical tone forming characteristics, a plurality of musical tones which are formed simultaneously become different due to the tone generating channels to which the musical elements of the musical tones are assigned. Moreover, as above described, since the key codes KC corresponding to depressed keys are irregularly or randomly assigned to the channel processor 20, even for the same depressed key (the same key code KC), different tone generating channels are assigned thereto with the result that random musical tones having the same tone pitch but slightly different musical elements can be produced.

Having described the outline of the construction and operation of the musical instrument of this invention, the detail thereof will now be described.

B. Detail of the Construction and Operation of Various Circuit Units

Since the key coder is described in copending United States patent application Ser. Nos. 712815, now U.S. Pat. No. 4,148,017 filed Aug. 9, 1976, 714084, now U.S. Pat. No. 4,114,495 filed Aug. 13, 1976 and 807894 filed June 20, 1977 and since the key code-tone pitch voltage converter is described in U.S. patent application Ser. No. 807894 filed June 20, 1977, any description thereof will not be made herein.

1. Timing Signal Generator 100

Figure 2:
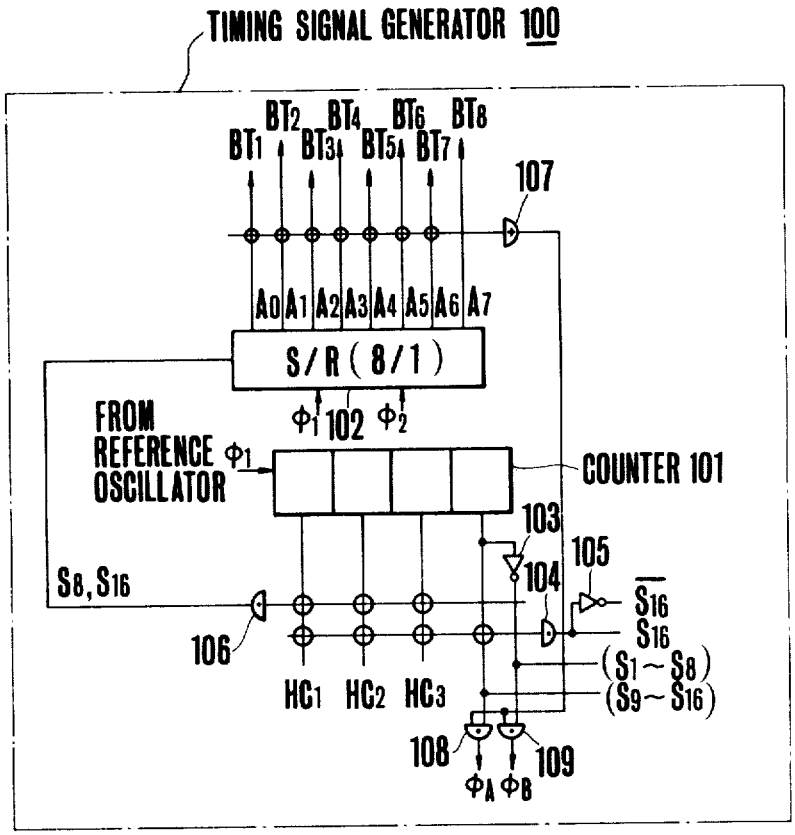
FIG. 2 is a connection diagram showing the detail of the timing signal generator shown in FIG. 1.

The detail of the timing signal generator 100 shown in FIG. 1A is shown by FIG. 2. The timing signal generator 100 generates various timing signals acting as the references of various operations of the electronic musical instrument. To have better understanding of the invention, the timing signal generator 100 will firstly be described. This generator comprises a four bit counter 101 constituted by 4 cascade-connected flip-flop circuits and a shift register 102 having a plurality of bits of the same number as that of the channels (in this example, 8 channels). The counter 101 counts the number of a clock pulse $\phi_1$ shown in FIG. 8A, the pulse $\phi_1$ being obtained by frequency dividing an output pulse $\phi$ of a reference oscillator, not shown. The clock pulse $\phi_1$ is an extremely high speed pulse having a period of 1 $\mu$s, for example. Hereinafter, the pulse period is termed a "channel time". Where 8 tones are generated simultaneously, the number of necessary channels is also 8 and the time slots sequentially partitioned by the clock pulse $\phi_1$ and having a width of 1 $\mu$s are sequentially driven corresponding to first to eighth channels, as shown in FIG. 8B. This is necessary because in the channel processor 20 various memory circuits and logic circuits are caused to cooperate on a time sharing basis to act dynamically for the purpose of simultaneously producing a plurality of musical tones. As shown in FIG. 8B, 8 channel times are generated cyclically, wherein respective channel slots are represented by the first to eighth channel times. In other words, when a clock pulse $\phi_1$ is applied to the input terminal of the counter 101 from the reference oscillator, not shown, the counter 101 sequentially counts the number of clock pulses $\phi_1$ and produces the result of counting as a binary-decimal code of the parallel 4 bit construction. Among these outputs, the output of the flip-flop circuit at the highest order is sent out (pulses $S_1$-$S_8$) during the first to eighth channel times through an inventer 103, as shown in FIG. 8C. Furthermore, as shown in FIG. 8D, the highest order flip-flop circuit produces pulses $S_9$–$S_{16}$ which are not inverted by the inverter 103. The parallel 4 bit output signals of respective flip-flop circuits of the counter are applied to the inputs of an AND gate circuit 104 to detect the full count condition of the counter. Thus, a pulse $S_{16}$ shown in FIG. 8E is derived out at the full count condition, and converted into a pulse $\overline{S_{16}}$, FIG. 8F, by an inventer 105. Pulse $S_{16}$ is generated at each assignment processing time (16 $\mu$s) of the channel processor 20 meaning that respective channel times circulate twice during the processing time. Because, in the channel processor, during the first eight channel times, input key code is compared with a stored key code KC which has already been assigned and during the next eight channel times writing is performed. Pulses $S_1$–$S_8$ shown in FIG. 8C and pulses $S_9$–$S_{16}$ shown in FIG. 8D occupy the first 8 channel times and the second 8 channel times, respectively. The AND gate circuit 106 is enabled when the first to third parallel four bit outputs of the counter 101 are applied to its inputs to produces pulses $S_8$ and $S_{16}$ which are produced at an interval of 8 channel times, as shown in FIG. 8G. These pulses $S_8$ and $S_{16}$ are supplied to an 8 stage shift register 102 in which they are sequentially shifted up. Respective stages of the shift register produce pulses $BT_1$ through $BT_8$ shown in FIGS. 8J through 8Q which are produced as if the first to eighth channel times were sequentially sampled. In other word, the outputs of respective stages of the shift register correspond to signals produced by parallelly deriving out a timing signal corresponding to the first to eighth channel times. The outputs of the first to seventh stages of the shift register 102 are applied to the inputs of an OR gate circuit 107 having an output connected to one input of an AND gate circuit 108. When the output of the OR gate circuit 107 and the output of the highest order stage of the counter 101 are applied simultaneously, the AND gate circuit 108 is enabled to produce a clock pulse $\phi_A$ shown in FIG. 8H. An AND gate circuit 109 is enabled when the outputs of the OR gate circuit 107 and the inverter 103 are applied to its inputs thus producing a clock pulse $\phi_B$ shown in FIG. 8I.

These pulse signals and clock pulses are used as the timing signals for synchronously operating various circuit units of the electronic musical instrument. The operations of various circuit units utilizing such timing signals will now be described in detail.

2. Channel Processor 20

Figure 3:
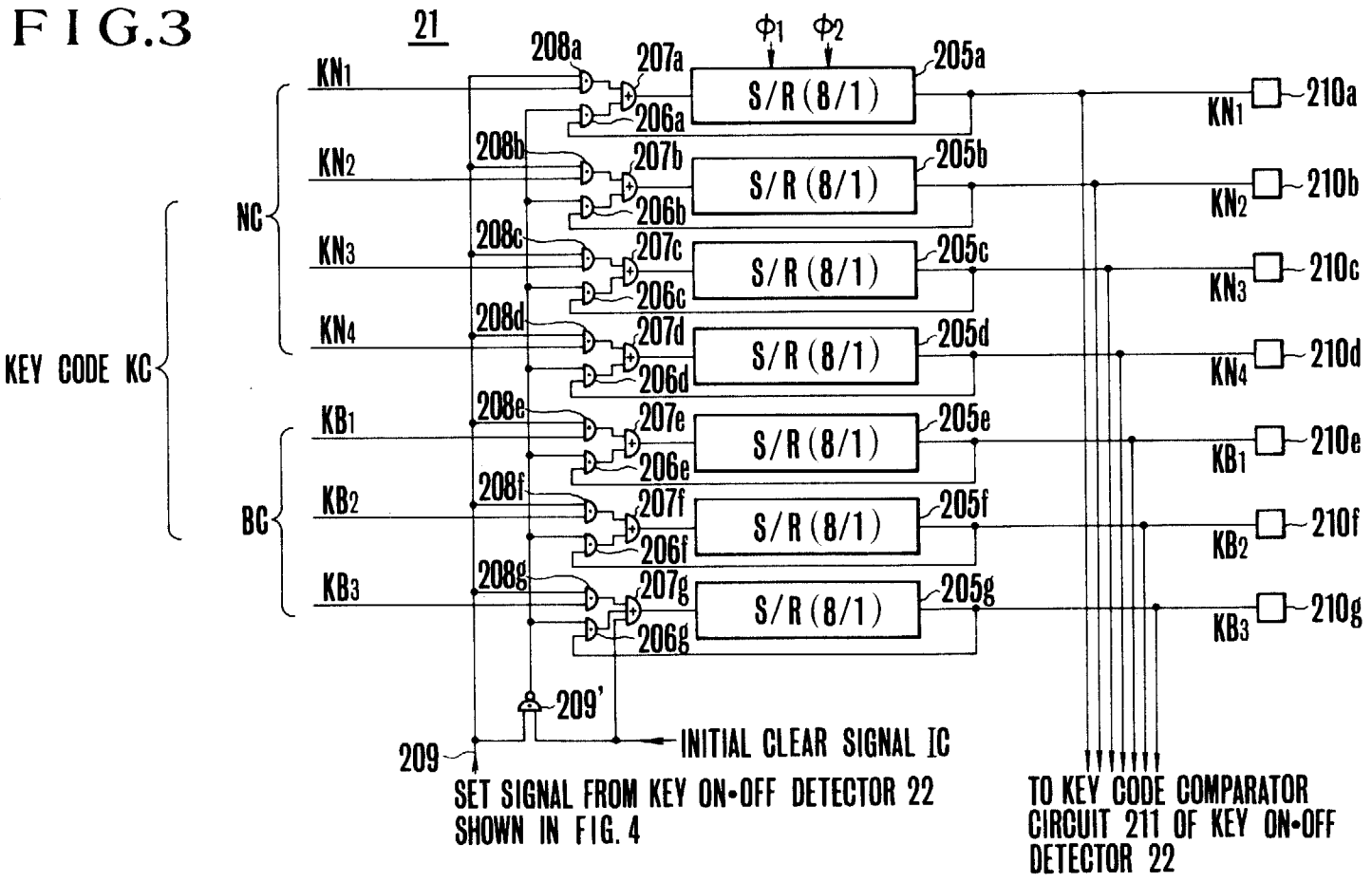
FIG. 3 is a block connection diagram showing the detail of the key code memory circuit shown in FIG. 1.
Figure 4:
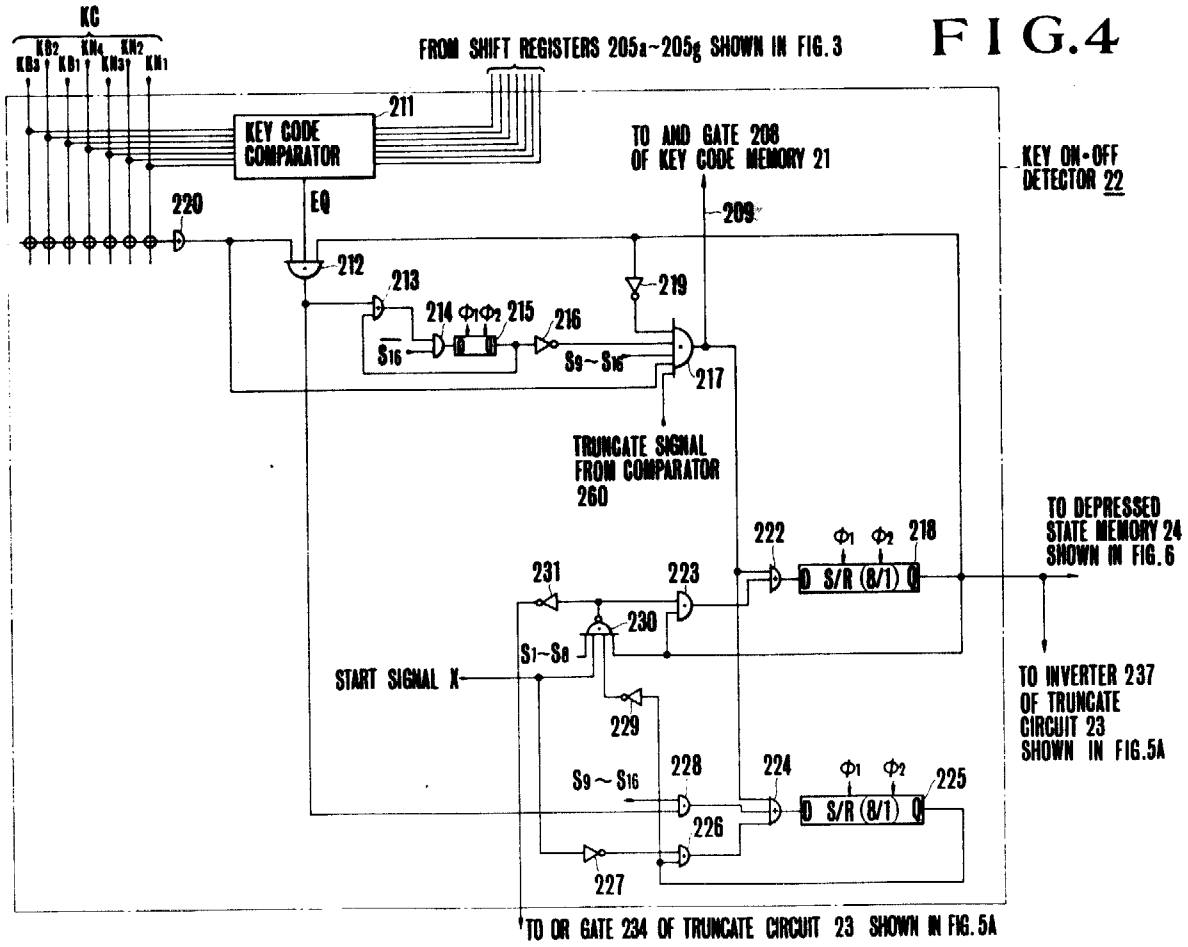
FIG. 4 is a connection diagram showing the detail of the key ON.OFF detector shown in FIG. 1.
Figures 5A, 5C:
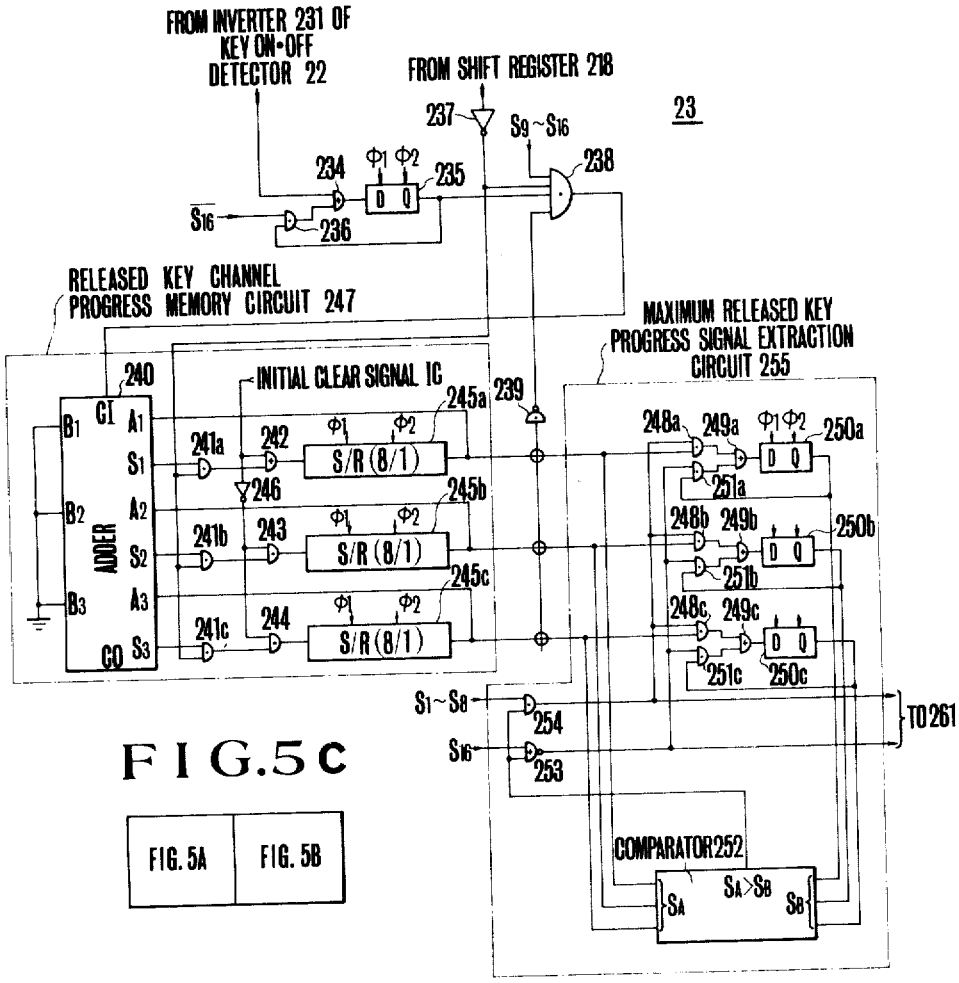
FIGS. 5A and 5B, when combined as shown in FIG. 5C, are connection diagrams showing the detail of the truncate circuit shown in FIG. 1.
Figure 5B:
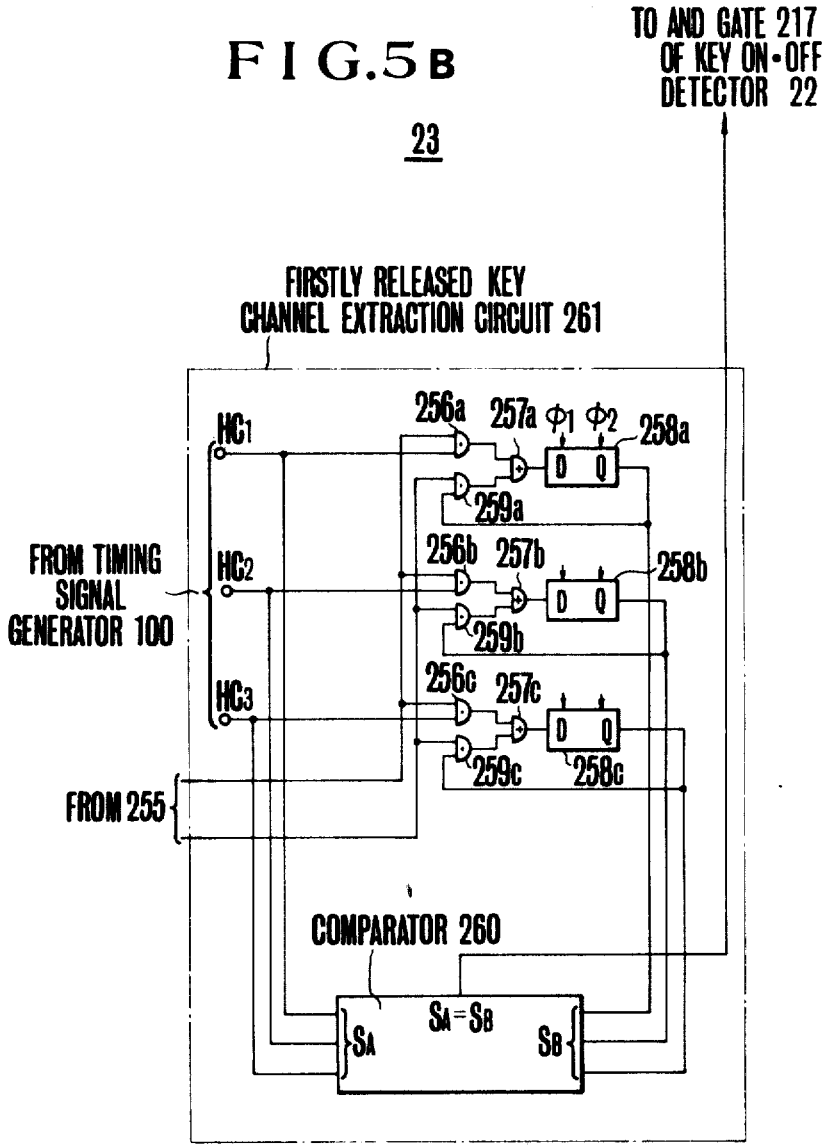
Figure 6:
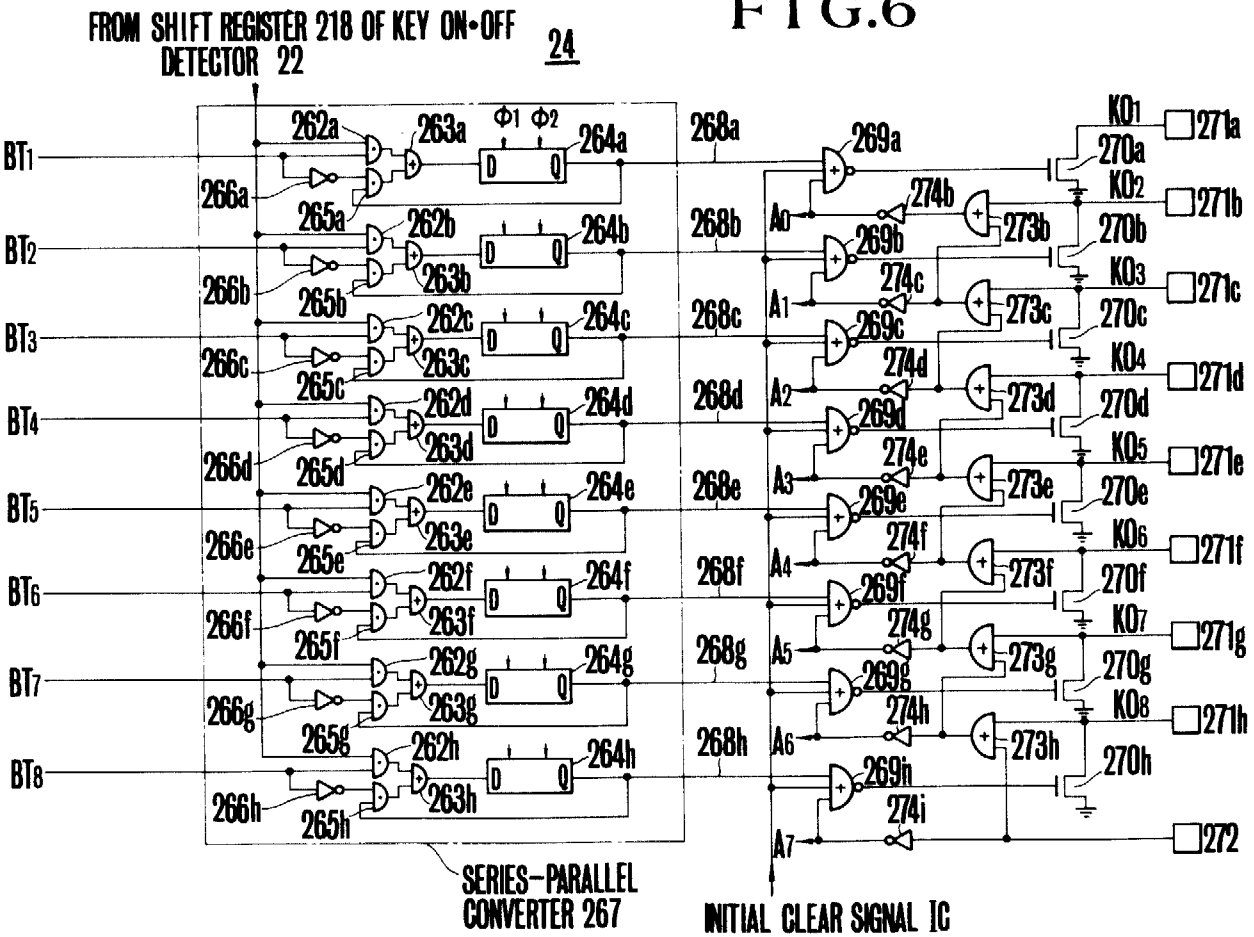
FIG. 6 is a connection diagram showing the detail of the depressed key state memory circuit.

The channel processor 20 is constituted by a key code memory circuit 21 shown in FIG. 3, a key ON·OFF detector 22 shown in FIG. 4, a truncate circuit 23 shown in FIG. 5 and a depressed key state memory circuit 24 shown in FIG. 6. The key code memory circuit 21 shown in FIG. 3 is provided with shift registers **205*a* through 205*g* for respective bits $KN_1$-$KN_4$ and $KB_1$-$KB_3$ of the key code KC. The number of stages (that is memory positions) of each shift register is equal to the number of musical tones that can be produced at the same time, that is the number of channels (in this example, 8). The shift registers 205*a* through 205*g* are driven by two phase clock pulses, comprising the clock pulse $\phi_1$ shown in FIG. 8A and the clock pulse $\phi_2$ of the opposite phase so that their contents are sequentially shifted. The outputs from the last stages of the shift registers are fed back to their inputs respectively through AND gate circuits 206*a* through 206*g* and OR gate circuits 207*a* through 207*g*. Accordingly, each shift register comprises an 8 stage 7 bit circulating type shift register, and the registers as a whole can store parallel bit key codes KC of the number equal to the number of channels. A key code KC constituted by bits $KN_1$-$KN_4$ and bits $KB_1$-$KB_3$ is applied to the inputs of the shift registers 205*a*–205*g* respectively through AND gate circuits 208*a*–208*g* and OR gate circuits 207*a*–207*g*. Consequently, when a set signal is applied to a line 209 from a key ON·OFF detector 22 to be described later, the AND gate circuits 203*a*–208*g* are enabled to apply the bit signals $KN_1$-$KN_4$ and $KB_1$-$KB_3$ to the respective inputs of shift registers 205*a*–205*g* so that these bit signals are written into and held by the stages corresponding to a channel to which the key code KC has not been assigned. A specific channel to which the stored key code KC (bits $KN_1$-$KN_4$ and $KB_1$-$KB_3$) has been assigned can be judged by the timing of outputs of shift registers 205a-205g which are driven by clock pulses $\phi_1$ and $\phi_2$ since the clock pulses $\phi_1$ and $\phi_2$ are synchronous with and correspond to channels to which the assignment is made on the time sharing basis. For this reason, the stored key codes KC assigned to respective channels are sequentially produced at the output terminals 210a-210g at each channel time and on the time sharing basis. These outputs are also fed back to the inputs of respective shift registers to continuously hold the memories. The output of a NAND gate circuit 209' is applied to one inputs of AND gate circuits 206a-206g, and to the inputs of the NAND gate circuit 209' are applied the set signal on line 209** and an initial clear signal IC.

The key ON-OFF detector 22 shown in FIG. 4 comprises a key code comparator 211 which compares the stored key code KC produced by the shift registers 205a-205g of the key code memory circuit 21 with the key code KC now being supplied from the key coder 10. The stored key code KC corresponding to respective channels and supplied to the key code comparator 211 is applied twice during one assigning period TP shown in FIG. 8B. More particularly, during the fore one half of the assigning period $TP_1$ (FIG. 8C) first to eighth channel times circulate once and again circulate once during the latter one half assigning period $TP_2$ (FIG. 8C). On the other hand, since the key code KC produced by the sampling and holding circuit 16 of the key coder 10 is read out by the clock pulse $\phi_B$ shown by FIG. 8I, the content of the key code KC does not vary during one assigning period TP. With the circuit having a construction as above described, the contents of the shift registers 205a-205g are circulated twice and then derived out during one assigning period TP whereby during the fore assigning period $TP_1$, a comparison is made as to whether a key code KC now being produced by the key coder 10 has already been stored or not (that is whether the key code KC has already been assigned to a specific channel or not), whereas during the aft assigning period $TP_2$, assignment is made in accordance with the result of comparison made in the fore half period. The coincidence detection signal EQ produced by the key code comparator 211 is "1" where coincidence is obtained whereas "0" when the coincidence is not obtained. During the comparison, the fact that an input key code KC has coincided with a key code that has been assigned to a specific channel is judged by the channel time in which the coincidence signal EQ becomes "1". For example, when a non-coincidence signal "0" is produced by the key code comparator 211 at the end of the fore half assigning period $TP_1$ (this means that an input key code KC has not yet been assigned to a specific channel) the output of the AND gate circuit 212 also becomes "0" which is stored in a delay flip-flop circuit 215 via an OR gate circuit 213 and an AND gate circuit 214. Since a pulse signal $S_{16}$ shown in FIG. 8F is applied to the other input of the AND gate circuit 214, the content of the delay flip-flop circuit 215 is maintained until one assignment period TP terminates. The output signal "0" of the delay flip-flop circuit 215 is inverted by an inverter 216 and then applied to one input of an AND gate circuit 217.

There is provided a shift register 218 having memory stages of the same number as the number of channels (in this example, 8) and driven by the clock pulses $\phi_1$ and $\phi_2$ in synchronism with respective channel times. The assigning stages of the channels are written as "0" for idle channels and "1" for assigned channels in the shift register 218. For this reason, an idle channel can be designated by judging the output of this shift register and the channel time in which output "0" is produced. When the shift register 215 produces a "0" output representing an idle channel, this "0" signal is applied to one input of AND gate circuit 217 via an inverter 219, and the other four inputs of the AND gate circuit 217 are supplied with the "1" signal applied through inverter 216, pulse signals $S_9$-$S_{16}$ (FIG. 8D) representing the aft half of the assignment period $TP_2$ "1" signal from OR gate circuit 220 which detects that the key code KC is now being supplied and a truncate signal from the comparator 260 of the truncate circuit 23, respectively. As will be described hereinafter, the truncate signal is generated in a channel time corresponding to a channel which is judged to be a channel whose associated key has been released at the earliest, and the truncate circuit is constructed to generate a single truncate signal in a corresponding channel time of the aft assignment period $TP_2$. Consequently, the AND gate circuit 217 produces a "1" signal during a channel time corresponding to a channel (which is represented by the truncate signal that the key associated therewith was released at the earliest among a number channels which produce "0" signals in a channel time corresponding to an idle channel. This "1" output signal of the AND gate circuit 217 is applied to a line 209 leading to the AND gate circuit 208 of the key code memory 21 to act as a set signal. In response to this set signal, the key code memory circuit 21 stores the input key code in a stage corresponding to an idle channel as above described. Further, the "1" output signal of AND gate circuit 217 is also written in a corresponding stage of the shift register 218 via OR gate circuit 222, that is the memory stage of the shift register 218 corresponding to a channel in which the input key code KC has already been written in the key code memory circuit 21 by the set signal on line 209, in other words the memory stage which has already been assigned.

A case will now be considered in which a input key code KC has already been assigned to a channel stored in the key code memory circuit 21. In this case, the coincidence detection signal EQ produced by the key code comparator 211 is "1" and this output is applied to one input of AND gate circuit 212. At the time when this output signal "1" is produced, the outputs of the shift register 218 and the OR gate circuit 220 are also "1" so that AND gate circuit 212 is enabled in a channel time in which the coincidence detection signal EQ="1", thus producing an output "1". This output signal "1" is supplied to the delay flip-flop circuit 215 through OR gate circuit 213 and AND gate circuit 214 and held therein until one assigning period TP (FIG. 8E) terminates in the same manner as above described. Since inverter 216 is provided on the output side of the delay flip-flop circuit 215, the AND gate circuit 217 does not produce "1" output signal when the key code comparator 211 produces a coincidence detection signal EQ="1" and no assigning operation is executed. At this time, the output of the shift register 218 is fed back to its input side through AND gate circuit 223 and OR gate circuit 222 so that the content of the shift register 218 is maintained. Under these conditions, signal "1" is applied to the other input of the AND gate circuit 223 unless a key is released. The description described above explains the channel assigning operation of the input key code KC of the key ON·OFF detector 22.

The released key detection operation of the key ON·OFF detector 22 will now be described. During the channel assigning operation described above, AND gate circuit 217 produces an output "1" in a channel time corresponding to a channel in which the assignment has been executed and this "1" signal representing completion of the channel assignment is written in a stage of the shift register 218 corresponding to said channel. Accordingly, the shift registor 218 has memories concerning the states of assigning of respective channels and the memory informations of the shift register 218 are sequentially shifted by clock pulses $\phi_1$ and $\phi_2$ corresponding to the channel time and sequentially produced from the last stage. These outputs are supplied not only to the depressed key state memory circuit 24 to be described hereunder but also to the input side of the shift register 218 via AND gate circuit 223 and OR gate circuit 222 thereby the memory informations are circulated and held.

The signal produced by the AND gate circuit 217 and representing assigned channels are sequentially written into an eight stage shift register 225 identical with the shift register 218 through an OR gate circuit 224. Accordingly, at this time the content of the shift register 225 is just equal to that of the shift register 218 and sequentially shifted through the shift register 225 by the same clock pulses $\phi_1$ and $\phi_2$. The signal produced by the last stage of shift register 225 is fed back to its input through an AND gate circuit 226 and an OR gate circuit 224 to be circulated.

A start signal X produced by the timing action of the clock pulse $\phi_B$ in the fourth stage $ST_0$ (waiting state) which is set each time when the sampling and holding circuit 16 of the key coder 10 shown in FIG. 1A completes its conversion of all depressed key switch signals into corresponding key codes KC, is supplied to the AND gate circuit 226 via an inverter 227 whereby the AND gate circuit 226 is disenabled. Accordingly, the feedback circuit of the shift register 225 is interrupted to reset its all contents. After resetting in this manner, the output signal of AND gate circuits 212 is written into the shift register 225 through AND gate circuit 228 and OR gate circuit 224 together with the output signal of the AND gate circuit 217. Through the operation described above signal "1" is written into a stage of the shift register 225 corresponding to a channel to which a key switch has been assigned which was actuated after the fourth or waiting state and the written signal is held in the shift register until a next start signal X is generated.

On the other hand, since the shift register 218 is never reset it continues to hold the signal "1" at a stage corresponding to a channel whose associated key has been released after the fourth state. Under these condition, when the fourth state is resumed again and a start signal is supplied, the output signal of the shift register 225 would not be fed back to the input side but supplied to one input of a NAND gate circuit 230 via an inverter 229, the other inputs of this NAND gate circuit 230 being supplied with pulse signals $S_1$–$S_8$ shown in FIG. 8c, the start signal X, the inverted output signal of the shift register 225 and the output signal of the shift register 218 respectively. Consequently, only during the fourth state $ST_0$ and during the pulse signals $S_1$–$S_8$ (fore assigning period $TP_1$), the outputs of the shift registers 218 and 225 are compared with each other. Where the output of the shift register 218 is "1" and that of the shift register 225 is "0", in other words during an interval subsequent to newest fourth state, and where a key code KC same as a key code assigned to a channel whose associated key has been released is not applied continuously, the output of inverter 229 becomes "1" so that the output of the NAND gate circuit 230 becomes "0" thus detecting a channel whose associated key has been released. For the reason described above, a channel associated with a released key can be determined by judging the channel time of the signal "0" produced by the NAND gate circuit 230. Since AND gate circuit 223 is disenabled by this output signal "0" of the NAND gate circuit 223, the output "1" of the shift register 218 will not be fed back to its input side with the result that the signal "1" of a stage corresponding to a channel whose associated key has been released is changed to signal "0".

An inverter 231 is connected to the output of the NAND gate circuit 230 for inverting its output "0" (representing that a channel whose associated key has been released) into a signal "1" which is supplied to the truncate circuit 23 described below.

The truncate circuit 23 will now be described. In the truncate circuit 23 shown in FIG. 5A abd 5B, when a channel whose released key is detected by the key ON·OFF detector 22, the NAND gate circuit 230 produces a released key channel detection signal "0" which is inverted into a "1" signal by the inverter 231 and this signal "1" is stored in a delay flip-flop circuit 235 via a OR gate circuit 234. The output of the delay flip-flop circuit 235 is fed back to its input via an AND gate circuit 236 and an OR gate circuit 234 to be held. At this time, since the other input of the AND gate circuit 236 is supplied with a pulse signal $\overline{S_{16}}$ shown in FIG. 8F, the content of the delay flip-flop circuit 235 is held until one assigning period TP terminates and then reset. When the shift register 218 of the key ON·OFF detector 22 produces an output, the inverter 237 supplies a signal "1" during the channel time corresponding to a not-assigned channel so that the AND gate circuit 238 produces a pulse signal corresponding to the "0" output of the shift register 218 during the aft assigning period $TP_2$ (pulse $S_9$–$S_{16}$. As will be described later, the output of the NAND gate circuit 239 at this time is "1". The output of AND gate circuit 238 is applied to an input terminal Cl of an adder 240 so as to be added to three bit signals [1] applied to other input terminals $A_1$, $A_2$ and $A_3$ of the adder, thereby producing a three bit sum signal at output terminals $S_1$, $S_2$ and $S_3$. To these output terminals $S_1$–$S_3$ are respectively connected AND gate circuits 241a, 241b and 241c with their one inputs connected to receive the output of an inverter 237. As a result, the AND gate circuits 241a–241c are enabled only when the inverter 237 does not produce an output, that is only during a channel time corresponding to a not-assigned channel for supplying their outputs to the input terminals of shift registers 245a through 245c respectively through an OR gate circuit 242 and AND gate circuits 243 and 244. At this time, the AND gate circuits 243 and 244 are enabled by a "1" signal supplied through an inverter 246. (At this time, an initial clear signal IC is not produced.) Each one of the shift registers 245a through 245c has memory stages of the number equal to the number of the channels (in this example, 8) and its content is sequentially shifted by clock pulses $\phi_1$ and $\phi_2$ which are synchronous with the channel time to produce an output from its last stage. The outputs of the shift registers 245a through 245c are supplied to the input terminals $A_1$, $A_2$ and $A_3$, respectively of the adder 240. Thus, these circuit components constitute a released key channel produce memory circuit 247 which sequentially adds [1] to the present count of a stage of the shift registers 245a–245c corresponding to an idle channel of the shift register 218. Since the released key channel progress memory circuit 247 comprises three parallelly connected shift registers 245a–245c, three bit parallel released key progress signals applied to respective channels are sequentially shifted corresponding to the channel times whereby a released key progress signal having the largest value is produced as a three bit signal (binary code) in a channel time corresponding to a channel whose associated key has been released at the earliest. As above described since the released key channel progress memory circuit 247 has a three bit construction as above described, the maximum value of its output is 7 ("111"). When [1] is added thereto 0 ("000") is obtained thus causing such difficulty that a channel whose key has been released at the latest will be misjudged as a channel whose key has been released at first. To prevent this difficulty, a NAND gate circuit 239 is provided on the output sides of the shift registers 245a through 245c which is enabled only when the outputs of the shift registers coincide with each other. The output of the NAND gate circuit 239 is used to disenable the AND gate circuit 238 so as to stop succeeding addition operations of that channel thus eliminating the difficulty just described. By performing the operations described above assigning operations are made sequentially by a circuit to be described later starting from a channel whose key has been released at the earliest. Because it is necessary to assign a new key code to a channel which is judged that its key was released at the earliest where a number of keys have been depressed since a sustain is being applied after key release. The respective bits of the three bit released key progress signals produced by the released key channel progress memory circuit 247 corresponding to respective channel times are applied to delay flip-flop circuits 250a through 250c through AND gate circuits 248a–248c and or gate circuits 249a–249c and stored in these delay flip-flop circuits. Since the three bit signals stored in the delay flip-flop circuits 250a–250c are written by clock pulse $\phi_1$ and read out by clock pulse $\phi_2$ the outputs lag the inputs by one clock pulse period. These output signals of the delay flip-flop circuits 250a–250c are fed back to the input sides thereof through AND gate circuits 251a–251c and OR gate circuits 249a–249c respectively thus holding the contents. Thus, the delay flip-flop circuits 250a–250c constitute a memory circuit for storing 3 bit signals. The outputs of these delay flip-flop circuits are applied to a comparator 252 as a three bit released key progress signal $S_B$ which is compared with a new released key progress signal $S_A$ supplied from the released key channel progress memory circuit 247. The comparator 252 produces an output "1" only when $S_A > S_B$ which is applied to one inputs of AND gate circuits 251a–251c respectively through a NOR gate circuit 253 to act as a "0" signal thereby preventing feeding back of the outputs of the delay flip-flop circuits 250a–250c to their inputs. Moreover, as the output signal "1" of the comparator 252 is applied to one input of AND gate circuit 254, this AND gate circuit is enabled during the fore assigning period TP, and its output causes respective bit signals of a new released key progress signal A produced by the memory circuit 247 to be stored in the delay flip-flop circuits 250a–250c respectively through AND gate circuits 248a–248c. Thus, these circuit elements cooperate to constitute a maximum released key progress signal extraction circuit 235 which extracts the maximum one of the released key progress signals of respective channels. Consequently, at the end of the fore assigning period $TP_1$, only the maximum released key progress signal would be stored in the delay flip-flop circuits 250a–250c and these flip-flop circuits are reset by the pulse signal $S_{16}$ (FIG. 8E) at the end of one assigning period TP. The output signal produced by the AND gate circuit 254 during the fore assigning period $TP_1$ is supplied to one inputs of AND gate circuits 256a–256c (see FIG. 5B) for storing in respective flip-flop circuits 258a–258c the three bet encoded channel signals produced by the timing signal generator 100 (FIG. 2) at this time, that is channel code signals $HC_1$ through $HC_3$ (produced by converting channel times into binary codes). Similar to the maximum released key progress signal extraction circuit 255, the contents of these delay flip-flop circuits 258a–258c correspond to the channel code signals $HC_1$–$HC_3$ representing the channels in which the maximum released key progress signals are produced during the fore assigning period $TP_1$ because the output of the NOR gate circuits 253 is applied to one inputs of the AND gate circuits 259a–259c. The channel code signals $HC_1$–$HC_3$ stored in the delay flip-flop circuits 258a–258c and representing the channels in which the maximum released key progress signals are produced are held until one assigning period TP terminates, and reset by pulse signal $S_{16}$ (FIG. 8E) supplied through the NOR gate circuit 253. The channel code signals $HC_1$–$HC_3$ stored in the delay flip-flop circuits 258a–258c are applied to a comparator 260 to be compared with input channel code signals $HC_1$ through $HC_3$. When a coincidence is obtained, the comparator 260 produces a coincidence signal "1" which is applied to one input of an AND gate circuit 217 of the key ON·OFF detector 22 to act as a truncate signal. Since the channel code signals $HC_1$–$HC_3$ circulate twice during one assigning period $TP_1$ the channel code signals are written into the delay flip-flop circuits 258a–258c during the first circulation period (the fore assigning period $TP_1$). Consequently, the comparator 260 produces a coincidence signal only once during a given channel time in the aft assigning period $TP_2$. For this reason, these circuit elements cooperate to constitute a firstly released key channel extraction or detection circuit 261 which produces a pulse signal utilized as the truncate signal in a channel time corresponding to the firstly released key channel (that is a channel in which the truncate progresses to the largest extent) in each second half assignment period $TP_2$ thus positively designating only once a channel of the key ON·OFF detector 22, to which a new key code KC is to be assigned. The reason that an initial clear signal IC is written into only the shift register 245a of the released key channel progress memory circuit 247 via OR gate circuit 242 is to make sure the truncate operation under the first state by firstly writing a signal "1" into all stages of the shift register 245a. More particularly, when all contents of the shift registers 245a–245c are reset the comparator 252 of the maximum released key progress signal extraction circuit 255 would not produce signal "1" which is produced when $S_A > S_B$. Consequently, channel signals $HC_1$–$HC_3$ will not be stored in the delay flip-flop circuits 258a–258c of the circuit 261 for detecting a channel whose key has been released at the earliest so that the delay flip-flop circuits 258a–258c are maintained in a reset state caused by a pulse signal supplied through NOR gate circuit. Accordingly, there is a defect that a condition $S_A = S_B$ can not be obtained by the comparator 260 whereby no truncate signal is produced and the firstly produced key code signal KC can not be assigned. To obviate this problem, signal "1" is written in all stages of the shift register 245 by using the initial clear signal IC. The writing of the signal "1" by the initial clear signal IC is not limited to the shift register 245a but the signal may be written into at least one of the shift registers 245a–245c connected in parallel. Above description concerns the operation of the truncate circuit 23 that designates only one channel in which truncate has proceeded most.

The depressed key state memory circuit 24 will now be described in detail with reference to FIG. 6. To one inputs of AND gate circuits 262a–262b are sequentially applied the output signal of the shift register 218 of the key ON-OFF detector 22 described above. As has been pointed out above, signal "1" has been written in only a stage of the shift register 218 corresponding to a channel to which the key code has been assigned, whereas the content of the stage corresponding to a channel whose key has been released (that is an idle channel) has been changed to "0". As a consequence, signals sent out, on a time sharing basis, from the shift register 218 corresponding to respective channels represent the states of the keys assigned to respective channels at that time. The contents thus stored in the shift register 218 are sequentially shifted and sent out therefrom by the clock pulses $\phi_1$ and $\phi_2$ and applied to the depressed key state memory circuit 24. Where the output is at a state of "1", that is in a channel time in which a key corresponding to an assigned key code KC has been depressed, AND gate circuits 262a–262b are enabled when the timings of the channel signals $BT_1$–$BT_8$ which are sequentially produced on the time sharing basis as shown in FIG. 8J–8Q by the timing signal generator 100 (FIG. 2) corresponding to respective channels (channel times) coincide with each other. The outputs of these AND gate circuits 262a–262h are stored in delay flip-flop circuits 264a–264h respectively corresponding to the first to eighth channels through OR gate circuits 263a–263h. The outputs of the delay flip-flop circuits 264a–264h are fed back to their inputs to be held therein. Consequently, signal "1" supplied by shift register 218 (FIG. 4) and representing a depressed key channel is stored only in the stages of the delay flip-flop circuits 264a–264h corresponding to given channels, and the signal "1" thus stored until the AND gate circuits 265a–265h are disenabled by channel signals $BT_1$–$BT_8$ which are produced next time on the time sharing basis and applied to one inputs of the AND gate circuits through inverters 266a–266h respectively. Thus for example, when a signal "1" is produced by the shift register 218 (FIG. 4) in the third channel time shown in FIG. 8B, the channel signal produced in the third channel time comprises only the channel signal $BT_3$ as shown by FIG. 8L. As a consequence, only the AND gate circuit 262c is enabled and its output signal is written in the delay shift register 264c via the OR gate circuit 263c. Thus, it will be seen that these circuit elements constitute a series-parallel converter 267 which converts signals which are serially produced on the time sharing basis corresponding to the channel times and representing the depressed keys assigned to channels of the shift register 218 into 8 channel parallel signals. Accordingly, the delay flip-flop circuits 264a–264h of the series-parallel converter 267 are sequentially written with the signal produced by the shift register 218 (FIG. 4) and representing the depressed key states of the channels by the action of the channel signals $BT_1$ through $BT_8$. The series-parallel converter 267 produces signal "1" on only one of the output lines 268a–268b corresponding to a channel which is assigned with a key code KC and having a depressed key corresponding to the key code. For example, when a key associated with the third channel has been depressed as above described, signal "1" will be produced on line 268c. The signals "1" thus produced and corresponding to channels having depressed keys are applied to the gate electrodes of field effect transistors 263a–263h respectively through NOR gate circuits 270a–270h to turn OFF these field effect transistors for producing signals "1" on the output terminals 271a–271h corresponding to the first to eight channels, respectively. For example, where the third channel is designated as above described, signal "1" is supplied to NOR gate circuit 269c from the delay flip-flop circuit 264c via line 268c and only the field effect transistor 270c is turned OFF by the output signal "0" of the NOR gate circuit 269c. As a result, signal "1" appears on only the output terminal 271c whereas signals "0" appear on the other output terminals 271a, 271b, 271d–271h. This means that the key associated with a channel corresponding to terminal 271c which is supplied with the signal "1" has been depressed. This signal "1" that is the key ON signal KO is used to control corresponding one of tone pitch voltage control circuits 40a–40h of the tone pitch voltage control unit 40 for respective channels to be described later in detail.

3. Musical Tone Element Control Unit 50

Figure 7A:
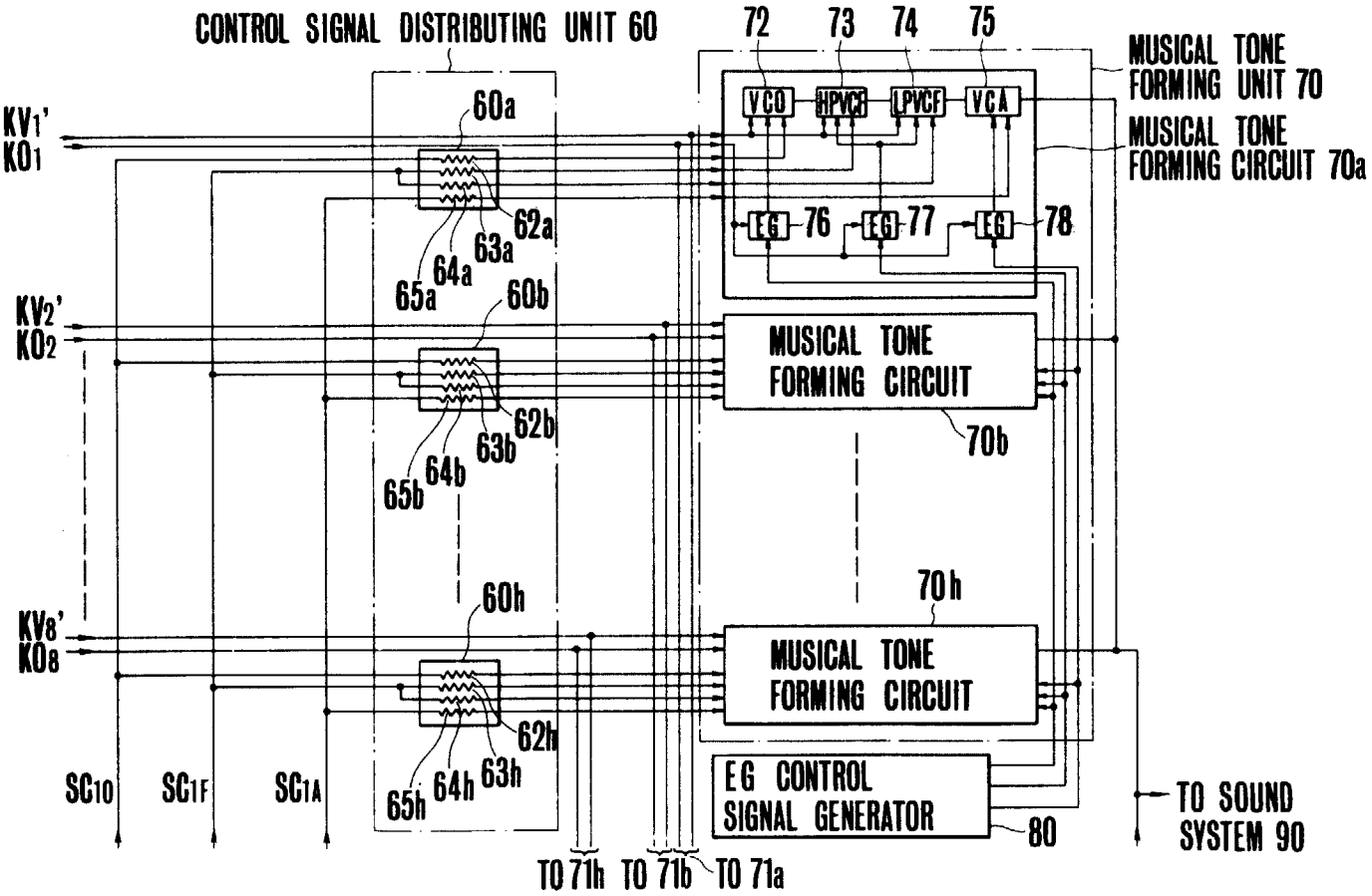
FIGS. 7A and 7B, when combined as shown in FIG. 7C, show detailed circuits of the musical tone element control unit, the control signal distributing unit, and the musical tone forming unit shown in FIG. 1.
Figures 7A, 7B, 7C:
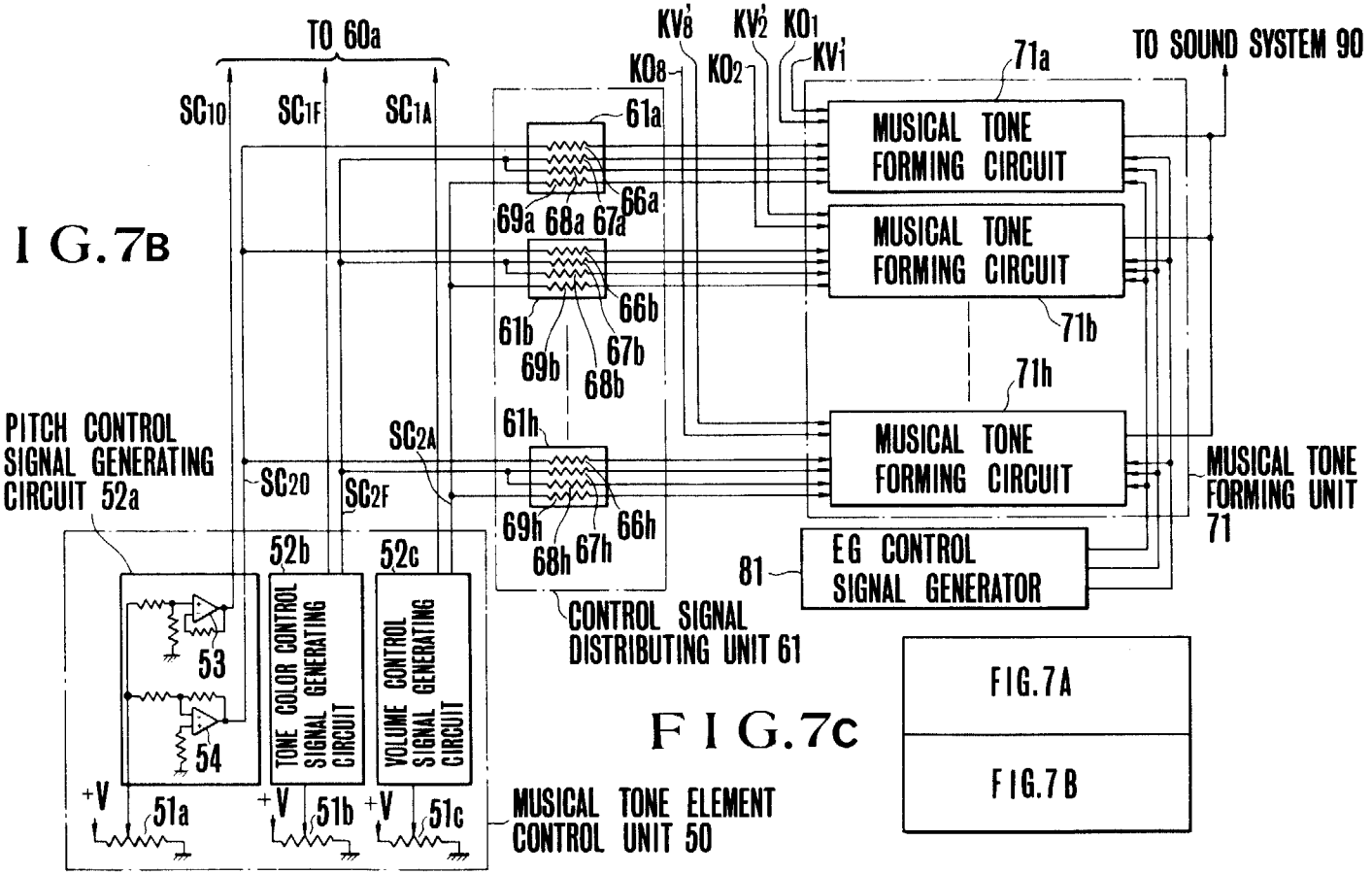

As shown in FIG. 7A and 7B, the musical tone element control unit 50 comprises variable resistors 51a, 51b, and 51c which are provided to correspond to VCO, VCF and VCA (described later) of the musical tone forming circuits 70a–70h and 71a–71h and are operated by manual operating members on the operating panel for dividing a source voltage (+15V), a pitch control signal generating circuit 52a, a tone color control signal generating circuit 52b, and a volume control signal generating circuit 52c respectively supplied with the output voltages of the variable resistors 51a, 51b and 51c for generating pitch control signals $SC_{10}$ and $SC_{20}$, tone color control signals $SC_{1F}$ and $SC_{2F}$, and volume control signals $SC_{1A}$ and $SC_{2A}$, respectively having opposite polarities and constituting musical element control signals $SC_1$ and $SC_2$.

Respective control signal generating circuits 52a–52c comprises a first comparator 53 supplied with the non-inverted output voltages of variable resistors 51a–51c for generating control signals $SC_{10}$, $SC_{1F}$ and $SC_{1A}$ of the positive polarity, and a second comparator 54 supplied with the inverted output voltages of the variable resistors 51a–51c for generating control signals $SC_{20}$, $SC_{2F}$ and $SC_{2A}$ of the negative polarity. By suitably varying the settings of variable resistors 51a–51c, it is possible to generate control signals $SC_{10}$, $SC_{1F}$, $SC_{1A}$ and $SC_{20}$, $SC_{2F}$, $SC_{2A}$ having opposite polarities but substantially the same absolute values.

4. Control Signal Distributing Units 60 and 61

As shown in FIG. 7A and 7B, the control signal distributing units 60 and 61 are constituted by set circuits 60a–60h and 61a–61h respectively corresponding musical tone forming circuits 70a–70h and 71a–71h respectively. Respective set circuits 60a–60h and 61a–61h are constituted by resistors 61a–62h and 66a–66h for setting and controlling the levels of the pitch control signals $SC_{10}$ and $SC_{20}$ generated by the control signal generating circuit 52a and supplied to the musical tone forming circuits 70a–70h and 71a–71h for respective channels; resistors 63a–63h, 64a–64h, 67a–67h and 68a–68h for independently setting and controlling the levels of the tone color control signals $SC_{1F}$ and $SC_{2F}$ generated by the control signal generating circuit 52b for respective channels; and resistors 65a–65h and 69a–69h for independently setting and controlling the levels of the volume control signals $SC_{1A}$ and $SC_{2A}$ generated by the control signal generator 52c for respective channels. The values of the resistors 62(*a–h*), 63(*a–b*), 64(*a–h*), 65(*a–h*), 66(*a–h*), 66(*a–h*) 67(*a–h*), 68(*a–h*) and 69(*a–h*) are selected as shown in the following Table 2, for example.

Table 2

| | 1st group | | | | 2nd group | | | |
|---|---|---|---|---|---|---|---|---|
| channel | resistor 62 | resistor 63 | resistor 64 | resistor 65 | resistor 66 | resistor 67 | resistor 68 | resistor 69 |
| 1a | 100 | 270 | 220 | 68 | 820 | 120 | 180 | 180 |
| 2b | 150 | 820 | 390 | 100 | 390 | 100 | 150 | 120 |
| 3c | 220 | 100 | 120 | 180 | 270 | 820 | 120 | 100 |
| 4d | 390 | 150 | 180 | 56 | 220 | 390 | 100 | 82 |
| 5e | 120 | 220 | 270 | 82 | 180 | 270 | 820 | 68 |
| 6f | 180 | 390 | 820 | 120 | 150 | 220 | 390 | 56 |
| 7g | 270 | 120 | 100 | 390 | 120 | 180 | 270 | 47 |
| 8h | 820 | 180 | 150 | 47 | 100 | 150 | 220 | 390 |

Remark unit: kilo ohms

5. Manual Tone Forming Units 70 and 71

As shown in FIGS. 7A and 7B the musical tone forming units 70 and 71 are constituted by two groups of musical tone forming circuits 70a–70h and 71a–71h corresponding to respective tone generating channels. Each of the musical tone forming circuit comprises a voltage controlled variable frequency oscillator (VCO) 72 whose oscillation frequency is controlled by one of the tone pitch voltages $KV'_2$–$KV'_8$ supplied from the tone pitch voltage control units 40a–40h, voltage controlled high pase and low pass filters HPVCF 73 and LPVCF 74 for shaping the tone source signal generated by VCO to have a desired tone, a voltage controlled variable gain amplifier (VCA) 75 which imparts a tone volume envelope to the musical tone signal shaped by the VCF 73 and VCF 74, and envelope waveform generators (EG) which generate envelope waveforms respectively corresponding to VCO 72, HPVCF 73, LPVCF 74 and VCA 75 for varying with time their oscillation frequencies, cut off frequencies and amplification factors respectively. The pitch control signals $SC_{10}$ and $SC_{20}$ having levels set by the resistors 62a–62h and 66a–66h of set circuits 60a–60h and 61a–61h which are provided independently for respective tone generating channels are applied to VCO 72 of each one of the musical tone forming circuits 70a–70h and 71a–71h so as to slightly vary the fundamental oscillation frequency of the VCO 72 thus controlling the pitch of the generated musical tone. The tone color control signals $SC_{1F}$ and $SC_{2F}$ having levels set by resistors 63a–63h, 67a–67h, 64a–64h, and 68a–68h of the set circuits are applied to HPVCF 73 and LPVCF 74 so as to control the fundamental cut off frequencies of these filters thus setting and controlling the color of the generated musical tone. Furthermore, volume control signals $SC_{1A}$ and $SC_{2A}$ having levels set by resistor 65a–65h and 69a–69h are applied to VCA 75 so as to control the fundamental amplification factor thereof thereby setting and controlling the volume of the generated musical tone.

Key ON signals $KO_1$–$KO_8$ for respective musical tone generating channels are applied to respective envelope generators EG 76, EG 77 and EG 78 provided for musical tone forming circuits 70a–70h, and 71a–71h from the depressed key state memory circuit 24 of the channel processor 20 so as to generate the envelope waveform signals in synchronism with the generation of respective key ON signals $KO_1$–$KO_8$ thereby controlling VCO 72, VCF 73, VCF 74 and VCA 75.

The waveforms (attack, sustain, decay and other waveform conditions) of the envelope waveform signals generated by respective envelope generators EG 76, EG 77 and EG 78 are set and controlled (commonly in each group) by the envelope waveform control signals generated by the envelope waveform control signal generators 80 and 81.

6. Operations of Musical Tone Control Unit 50, Control Signal Distributing Units 60, 61 and Musical Tone Forming Units 70, 71

Assume now that the voltages produced by the variable resistors 51a–51c of the musical tone element control units 50 are set to zero. Then, the first and second control signals $SC_{10}$, $SC_{20}$; $SC_{1F}$, $SC_{2F}$; and $SC_{1A}$, $SC_{2A}$ produced by respective control signal generating circuits 52a–52c are all zero so that none of the musical tone control signals $SC_1$($SC_{10}$, $SC_{1F}$, $SC_{1F}$), and $SC_2$($SC_{20}$, $SC_{2F}$, $SC_{2A}$) would be applied to the musical tone forming units 70 and 71 whereby these units are not influenced by the musical tone element control unit 50 and the control signal distributing units 60 and 61. Consequently, respective musical tone forming circuits 70a–70h and 71a–71h produce musical tone signals having tone pitches determined by the tone pitch voltages $KV'_1$–$KV'_8$ respectively supplied by the musical tone pitch forming circuits 70a–70b and 71a–71h and envelopes determined by the envelope voltages generated by envelope generators EG 76, EG 77 and EG 78 respectively. Thus, the musical tone forming circuits 70a–70h and 71a–71h of the musical tone forming units 70 and 71 produce musical tone signals having the same tone color and volume but different tone pitch. In other words, the musical tone generated by the musical tone forming circuits 70a–70h of the musical tone forming unit 70 belonging to the first group is identical to that generated by the musical tone forming circuits 71a–71h of the musical tone forming unit 71 belonging to the second group. This operation is similar to that of a conventional electronic musical instrument.

Figures 9A, 9B, 9C:
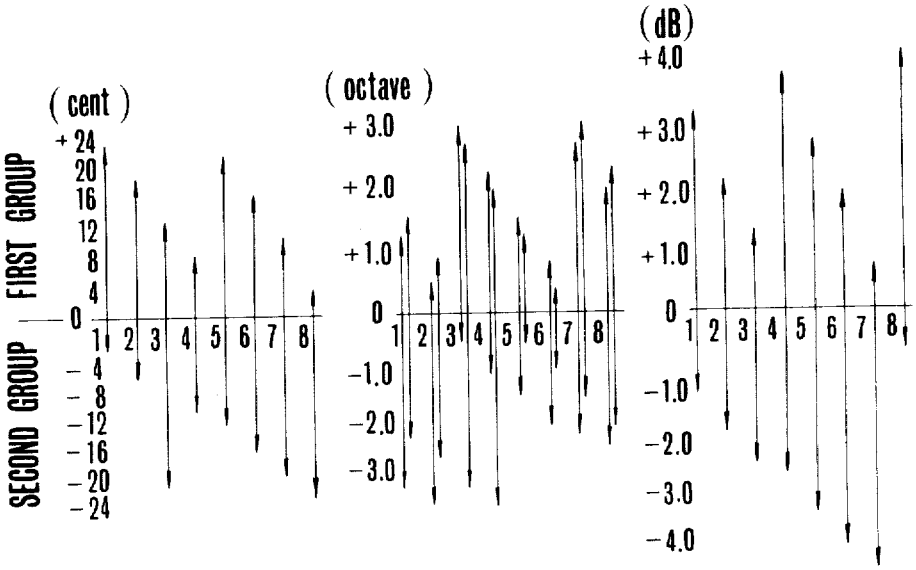
FIGS. 9A, 9B and 9C are graphs showing examples of the ranges in which the pitch, color and volume of the musical tone vary.

Then, the control members on the operating panel are operated to set the output voltages of the variable resistors 51a–51c of the musical tone element control unit 50 at certain values. Then the control signals $SC_{10}$, $SC_{1F}$ and $SC_{1A}$ of the first group generated by the control signal generating circuits 52a–52c respectively assume positive values determined by the output voltages of respective variable resistors 51a–51c, whereas the control signals $SC_{20}$, $SC_{2F}$ and $SC_{2A}$ of the second group assume negative values determined by the output voltages of respective variable resistors 51a–51c. It will be noted that the control signals $SC_{10}$, $SC_{20}$; $SC_{1F}$, $SC_{2F}$; and $SC_{1A}$, $SC_{2A}$ of the first and second groups generated by the musical tone element control unit 50 have opposite polarities but substantially the same absolute values. Thus control signals $SC_{10}$, $SC_{20}$; $SC_{1F}$, $SC_{2F}$; and $SC_{1A}$, $SC_{2A}$ generated in this manner for controlling the musical tone elements are respectively supplied to the VCO 72, HPVCF 73, LPVCF 74 and VCA 75 of respective musical tone forming circuits 70a–70h and 71a–71h via set circuits 60a–60h and 61a–61h provided for respective tone generating channels. Since the resistance values of the resistors 62(a—h), 63(a–h), 64(a–h), 65(a–h), 66(a–h), 67(a–h), 68(a–h) and 69(a–h) provided for respective set circuits 60a–60h and 61a–61h and set to the values shown in Table 2, the values of the control signals $SC_{10}$, $SC_{20}$; $SC_{1F}$, $SC_{2F}$; and $SC_{1A}$, $SC_{2A}$ are limited by these resistors, which may be fixed or semi-fixed resistors. Based on Table 2, when the musical tone forming circuits 70a and 71a are grouped into the first musical tone forming channel; the musical tone forming circuits 70h and 71h are grouped into the eighth musical tone forming channel; the musical tone forming circuits 70a–70h are grouped into the first group and when the musical tone forming circuits 71a–71h are grouped into the second group, the tone pitches of respective musical tone forming circuits 70a–70h and 71a–71h can be shown by a graph shown in FIG. 9A, the tone color by a graph shown in FIG. 9B, and the volume by a graph shown in FIG. 9c. FIGS. 9A, 9B and 9C show that the quantities of the musical elements vary randomly among respective musical tone forming channels of the same and different groups. The lefthand lines of groups of two parallel lines shown in FIG. 9B representing the tone color represent the characteristic of the high pass voltage controlled type variable frequency filter HPVCF whereas the righthand lines show that of the low pass voltage controlled type variable frequency filter LPVCF. This means that the musical tones simultaneously generated by the musical tone forming circuits 70a–70h of the musical tone forming unit 70 belonging to the first group have different pitches, colors and volumes thus manifesting sufficiently random property. Even with a given tone pitch voltage KV representing a given tone pitch, the musical tone elements of the generated musical tone become different depending upon the musical tone forming circuits 70a–70h and 71a–71h which are assigned to that tone pitch voltage KV thereby also manifesting the random property. FIGS. 9A, 9B and 9C also show the ranges of variations of respective musical tone elements which are set by the settings of respective variable resistors 51a–51c of the musical tone element control unit 50. As above described, the musical tone element control signals $SC_{10}$, $SC_{20}$; $SC_{1F}$, $SC_{2F}$; and $SC_{1A}$, $SC_{2A}$ respectively supplied to the first and second groups have opposite polarities so that these signals vary in the opposite directions. Consequently, as the output voltages of the variable resistors 51a–51c are increased by varying the settings thereof, the difference between the quantities of respective musical tone elements of the first and second groups increases.

As above described, since the musical tone forming channels are randomly assigned by the channel processor 20 and since the quantities of the musical tone elements generated by the respective musical tone forming circuits 70a–70h and 71a–71h are different, the generated musical tones are applied withs sufficiently large random properties thus enriching the performance tones.

While in the foregoing embodiment, the channel processor was constructed such that the truncate circuit 23 designates an assigned channel even in the presence of an idle channel, the invention is not limited to such specific construction. Thus, the random property can be improved further by using such channel processor as disclosed in copending U.S. patent application Ser. No. 714,084 filed on Aug. 13, 1976 and constructed to operate the truncate circuit only when there is no idle channel.

C. Modified Embodiment

FIG. 10 shows a modified embodiment of this invention in which only the circuit elements different from the above described embodiment are shown. In this modification, the output that is the key ON signal KO produced by the depressed key state memory circuit 24 is sent not only to the tone pitch voltage control unit 40 for respective channels and the musical tone forming units 70 and 71 but also to a plural depressed key memory circuit 120. This circuit 120 operates to detect whether a plurality of keys of the keyboard are in the depressed state or not and produce a plural depressed key detection signal PLK when a plurality of keys have been depressed. The depressed key state of the keyboard can be determined by inspecting the content of the depressed key state memory circuit 24 of the channel processor 20. Where a plurality of keys have been depressed, the key ON signals would have been stored in a plurality of channels of the memory circuit 24. As a result, the plural depressed key detection circuit 120 would receive the key ON signals KO ($KO_1$–$KO_8$) of respective channels from the depressed key state memory circuit 24 to judge that whether there are a plurality of applied key ON signals KO ($KO_1$–$KO_8$) or not. This detection is performed by a combination of two priority circuits and a coincidence circuit as will be described hereinbelow. The plural depressed key detection signal PLK enables a gate circuit 130 to supply the musical tone element control signals $SC_1$ and $SC_2$ to the control signal distributing unit 60 shown in FIG. 1 from the musical tone element control unit 50. Thus, only when a plurality of keys have been depressed, the musical tone element control signals $SC_1$ and $SC_2$ are applied to the musical tone forming units 70 and 71. Consequently, in the modified embodiment shown in FIG. 10, in response to the key ON signals KO ($KO_1$ through $KO_8$) produced by the depressed key state memory circuit 24, the plural depressed key detection circuit 120 detects a plurality of keys only when they are depressed to produce the plural depressed key detection signal PLK that enables the gate circuit 130. Accordingly, when the plural depressed key detection signal PLK is generated, that is when a plural tone performance is made on the keyboard, a first positive musical tone element control signal $SC_1$ set by a control member and produced by the musical tone element control unit 50 is applied to respective set circuits 60a–60h of the control signal distrubuting unit 60 via the gate circuit 130, whereas a second negative musical element control signal $SC_2$ is supplied to respective set circuits 61a–61h of the control signal distributing unit 61 via the gate circuit 130. In this case, when the set circuits 60a–60h and 61a–61h are set to different conditions, musical tone element control signals $SC_1$ and $SC_2$ determined by the set conditions of respective set circuits are applied to the musical tone forming circuits 70a–70h and 71a–71h of the musical tone forming units 70 and 71 so that these musical tone forming circuits produce musical tone signals having differnt pitch variation, color and tone.

Where the plural depressed key detection circuit 120 does not produce any plural depressed key detection signal PLK, that is when a monotoneous performance is done on the keyboard, the gate circuit 130 would not be enabled so that the musical tone element control signals $SC_1$ and $SC_2$ would not be applied to the musical tone forming circuits 70a–70h. Consequently these circuits 71a–71h produce musical tone signals having tone pitches designated by the tone pitch voltages $KV_1'$–$KV_8'$ applied thereto and having pitch variations, colors and volumes which are set by the musical tone forming circuits themselves independently of the musical tone element control signals $SC_1$ and $SC_2$.

The musical tone signals formed by the musical tone forming circuits 70a–70h and 71a–71h are respectively synthesized and then supplied to the sound system 90 including an expression circuit, a function circuit and an amplifier, not shown. Finally the synthesized musical tone signal is produced through a loudspeaker, not shown as a performance tone.

Accordingly, with the electronic musical instrument described above, where a monotoneous performance is made, a normal stable musical tone is produced not controlled by the musical tone element control signals $SC_1$ and $SC_2$. On the other hand, where a plural tone performance is made, as the musical tone forming characteristics of respective tone generating channels (that is musical tone forming circuits 70a–70h and 71a–71h) are controlled by different musical tone element circuit signals $SC_1$ and $SC_2$, a plurality of simultaneously generated musical tones comprise different musical tone elements. Moreover, since the key codes KC corresponding to the depressed keys and produced by the channel processor 20 are irregularly or randomly assigned, depending upon the tone generating channels assigned by the operated keys, the musical tone elements differ each other slightly thus imparting a random property to the generated musical tone.

In this manner, the generated musical tone is set and controlled in accordance with the state of performance (monotoneous or plural tone performance) on the keyboard.

Figure 11:
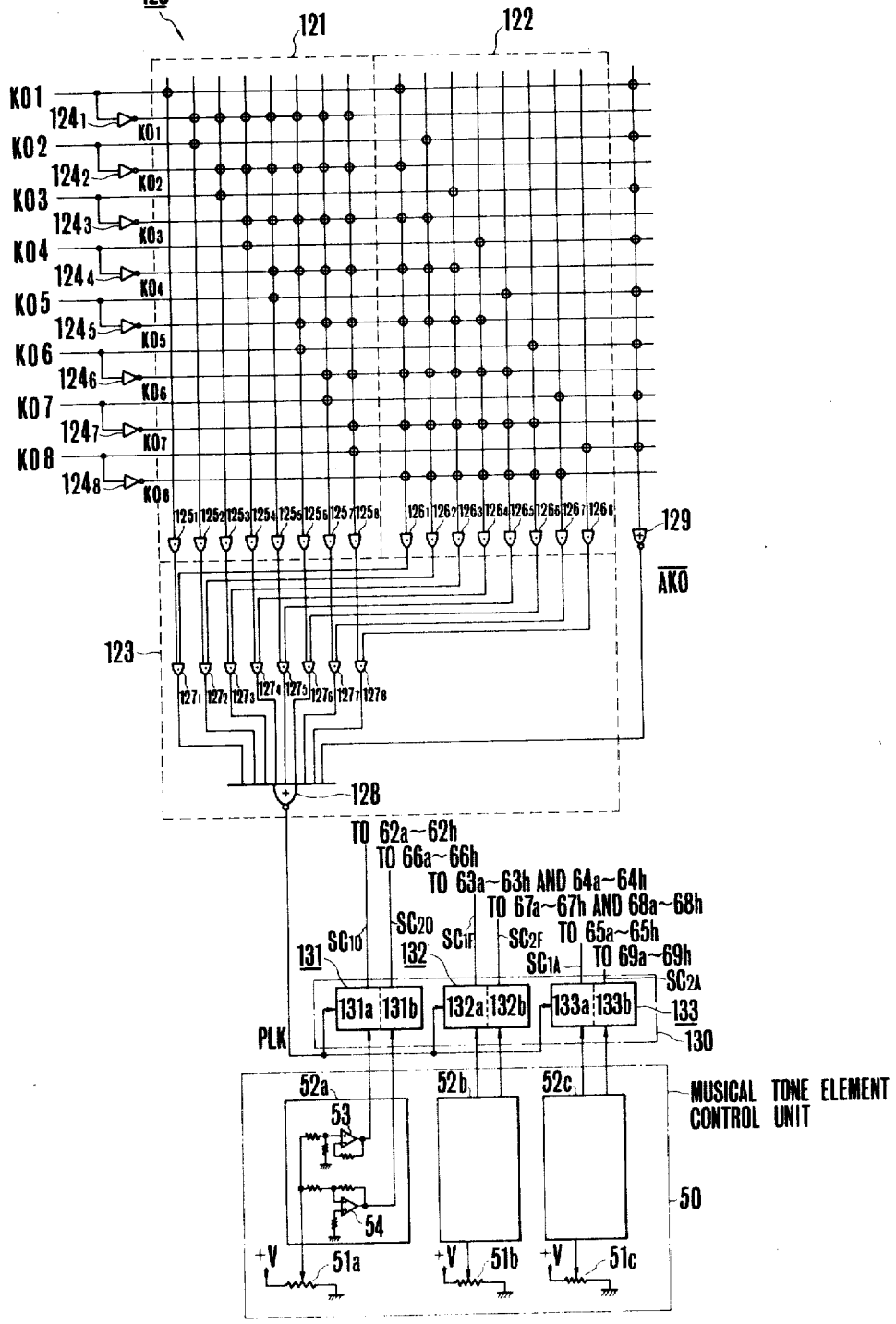
FIG. 11 is a connection diagram showing the detail of the modified embodiment shown in FIG. 10.

FIG. 11 shows the details of the musical tone element control unit 50, the plural depressed key detection circuit 120 and the gate circuit 130 which are constructed by first and second priority circuits 121 and 122 and a coincidence circuit 123.

The first and second priority circuits 121 and 122 are supplied with key ON signals $KO_1$ through $KO_8$ for respective channels from the depressed key state memory circuit 24 of the channel processor 20 and inverted key ON signals $\overline{KO_1}$–$\overline{KO_8}$ which are produced by inverting the key ON signals $KO_1$–$KO_8$ by inverters $\mathbf{122}_1$ through $\mathbf{124}_8$ respectively. The first priority circuit 121 operates in the order of the key ON signals $KO_1$, $KO_2$, $KO_3$ . . . $KO_8$ which are applied to one inputs of corresponding AND gate circuits $\mathbf{125}_1$–$\mathbf{125}_8$. To the other inputs of AND gate circuits $\mathbf{125}_2$–$\mathbf{125}_8$ which are supplied with key ON signals $KO_2$–$KO_8$ of lower orders of priority are applied inverted key ON signals $\overline{KO_1}$–$\overline{KO_7}$ which are obtained by inverting key ON signals $KO_1$–$KO_7$ of higher orders of priority than key ON signals $KO_2$–$KO_8$ by inverters $\mathbf{124}_1$–$\mathbf{124}_7$. More particularly, AND gate circuits $\mathbf{125}_1$ through $\mathbf{125}_8$ are supplied with key ON signals $KO_1$–$KO_8$ and inverted key ON signals $\overline{KO_1}$–$\overline{KO_7}$ as shown in the following Table 3.

Table 3

| AND gate | input signal |
|---|---|
| $125_1$(first channel) | $KO_1$ |
| $125_2$(second channel) | $KO_2$, $\overline{KO_1}$ |
| $125_3$(third channel) | $KO_3$, $\overline{KO_1}$, $\overline{KO_2}$ |
| $125_4$(fourth channel) | $KO_4$, $\overline{KO_1}$, $\overline{KO_2}$, $\overline{KO_3}$ |
| $125_5$(fifth channel) | $KO_5$, $\overline{KO_1}$, $\overline{KO_2}$, $\overline{KO_3}$, $\overline{KO_4}$ |
| $125_6$(sixth channel) | $KO_6$, $\overline{KO_1}$, $\overline{KO_2}$, $\overline{KO_3}$, $\overline{KO_4}$, $\overline{KO_5}$ |
| $125_7$(seventh channel) | $KO_7$, $\overline{KO_1}$, $\overline{KO_2}$, $\overline{KO_3}$, $\overline{KO_4}$, $\overline{KO_5}$, $\overline{KO_6}$ |
| $125_8$(eighth channel) | $KO_8$, $\overline{KO_1}$, $\overline{KO_2}$, $\overline{KO_3}$, $\overline{KO_4}$, $\overline{KO_5}$, $\overline{KO_6}$, $\overline{KO_7}$ |

The second priority circuit 122 is constructed to operate in the order of key ON signals $KO_8$, $KO_7$, $KO_6$ . . . $KO_1$. Thus, respective key ON signals $KO_1$–$KO_8$ are applied to one inputs of corresponding AND gate circuits $\mathbf{126}_1$–$\mathbf{126}_8$ of the second priority circuit 122. AND gate circuits $\mathbf{126}_7$–$\mathbf{126}_1$ are supplied with key ON signals $KO_7$–$KO_1$ of lower orders of priority and inverted key ON signals $KO_8$–$KO_2$ which are produced by inverting key ON signals $KO_8$–$KO_2$ of higher orders of priority than $KO_7$–$KO_1$ by inverters $\mathbf{124}_8$–$\mathbf{124}_2$. Signals applied to AND gate circuits $\mathbf{126}_1$–$\mathbf{126}_8$ are shown in Table 4.

Table 4

| AND gate | input signal |
|---|---|
| $126_1$(first channel) | $KO_1$, $\overline{KO_8}$, $\overline{KO_7}$, $\overline{KO_6}$, $\overline{KO_5}$, $\overline{KO_4}$, $\overline{KO_3}$, $\overline{KO_2}$ |
| $126_2$(second channel) | $KO_2$, $\overline{KO_8}$, $\overline{KO_7}$, $\overline{KO_6}$, $\overline{KO_5}$, $\overline{KO_4}$, $\overline{KO_3}$ |
| $126_3$(third channel) | $KO_3$, $\overline{KO_8}$, $\overline{KO_7}$, $\overline{KO_6}$, $\overline{KO_5}$, $\overline{KO_4}$ |
| $126_4$(fourth channel) | $KO_4$, $\overline{KO_8}$, $\overline{KO_7}$, $\overline{KO_6}$, $\overline{KO_5}$ |

Table 4-continued

| AND gate | input signal |
|---|---|
| $126_5$(fifth channel) | $KO_5$, $\overline{KO_8}$, $\overline{KO_7}$, $\overline{KO_6}$ |
| $126_6$(sixth channel) | $KO_6$, $\overline{KO_8}$, $\overline{KO_7}$ |
| $126_7$(seventh channel) | $KO_7$, $\overline{KO_8}$ |
| $126_8$(eighth channel) | $KO_8$ |

Consequently, when key ON signals $KO_2$ and $KO_5$, for example, are applied to the first and second priority circuits 121 and 122, in the first priority circuit 121 the key ON signal $KO_2$ corresponding to the second channel ins enabled to produce a signal "1". At this time, AND gate circuit $125_5$ supplied with key ON signal $KO_5$ is disenabled due to the inverted key ON signal $KO_2$. In the second priority circuit 122, AND gate circuit $126_5$ supplied with the key ON signal $KO_5$ corresponding to the fifth channel is enabled to produce a signal "1". At this time, AND gate circuit $126_2$ supplied with key ON signal $KO_2$ is disenabled due to inverted key ON signal $KO_5$. When only key ON signal $KO_1$ is applied to the first and second priority circuits 121 and 122 AND gate circuits $125_1$ and $126_1$ of the first and second priority circuits 121 and 122 are enabled to produce signals "1".

The outputs of the AND gate circuits $125_1$–$125_8$ and $126_1$–$126_8$ of the first and second AND gate circuits 121 and 122 are supplied to the inputs of AND gate circuits $127_1$–$127_8$ of the coincidence circuit 123.

More particularly, the outputs of AND gate circuit pairs $125_1$ and $126_1$; $125_2$ and $126_2$; $125_3$ and $126_3$; $125_4$ and $126_4$; $125_5$ and $126_5$; $125_6$ and $126_6$; $125_7$ and $127_7$; and $125_8$ and $126_8$ of the first and second priority circuits 121 and 122 which are supplied with the same key ON signals ($KO_1$–$KO_8$, respectively) are combined and respective combinations are applied to AND gate circuits $127_1$–$127_8$ respectively of the coincidence circuit 123. These AND gate circuits are enabled to produce signals "1" when all outputs of the pairs (the same channels) of the AND gate circuits of the first and second priority circuits 121 and 122 become "1". This is the case when a single key ON signal (one of $KO_1$–$KO_8$) is supplied to both priority circuits 121 and 122 as above described. On the other hand, when a plurality of key ON signals are supplied to both priority circuits 121 and 122, one of the AND gate circuits of respective pairs of AND gate circuits $125_1$ and $126_1$ . . . $125_8$ and $126_8$ always produces an outpout "0" so that all AND gate circuits $127_1$–$127_8$ of the coincidence circuit 123 are disenabled. The outputs of the AND gate circuits $127_1$–$127_8$ are applied to the inputs of a NOR gate circuit 128. This NOR gate circuit is enabled when all AND gate circuits $127_1$–$127_8$ produce signals "0", that is when a plurality of key ON signals KO are supplied, to produce an output signal "1" which is supplied to the gate circuit 130 to act as the aforementioned plural depressed key detection signal PLK thus enabling the gate circuit 130.

In this manner, the plural depressed key detection circuit 120 produces the plural depressed key detection signal PLK when a plurality of keys of the keyboard have been depressed so that when the key ON signals KO ($KO_1$–$KO_8$) are produced by a plurality of channels of the depressed key state memory circuit 24 of the channel processor 20.

When all channels of the depressed key state memory circuit 24 do not produce any key ON signal, that is under nonperformance state wherein no key of the keyboard has been depressed, the outputs of all AND gate circuits $127_1$–$127_8$ of the coincidence circuit 123 become "0" thereby preventing sending out of the plural depressed key detection signal PLK. To eliminate this difficulty, the plural depressed key detection circuit 120 is constructed to apply the key ON signals $KO_1$–$KO_8$ of all channels to the inputs of the NOR gated circuit. Accordingly, when no key ON signal is applied, the NOR gate circuit 129 produces a detection signal $\overline{AKO}$ (signal "1") which is applied to one input of the NOR gate circuit 128 of the coincident circuit 123. In this manner, there is no fear of producing the plural depressed key detection signal under the nonperformance state.

In this modification, a musical tone element control unit 50 identical to that shown in FIGS. 7A and 7B is also used.

The gate circuit 130 comprises three pairs of gate circuits 131, 132 and 133. When supplied with the output PLK of the plural depressed key detection circuit 120, each pair of gate circuits controls supply to the succeeding stages of the pitch control signals $SC_{10}$ and $SC_{20}$, the tone color control signals $SC_{1F}$ and $SC_{2F}$ which constitute the musical tone element control signals $SC_1$ and $SC_2$ send out from the musical tone element control unit 120. Each pair is constituted by a pair of transistors, for example, and produces a control signal for the succeeding stages when the PLK signal is applied to the base electrodes of the transistors.

D. Still Another Embodiment of the Invention

Figure 12:
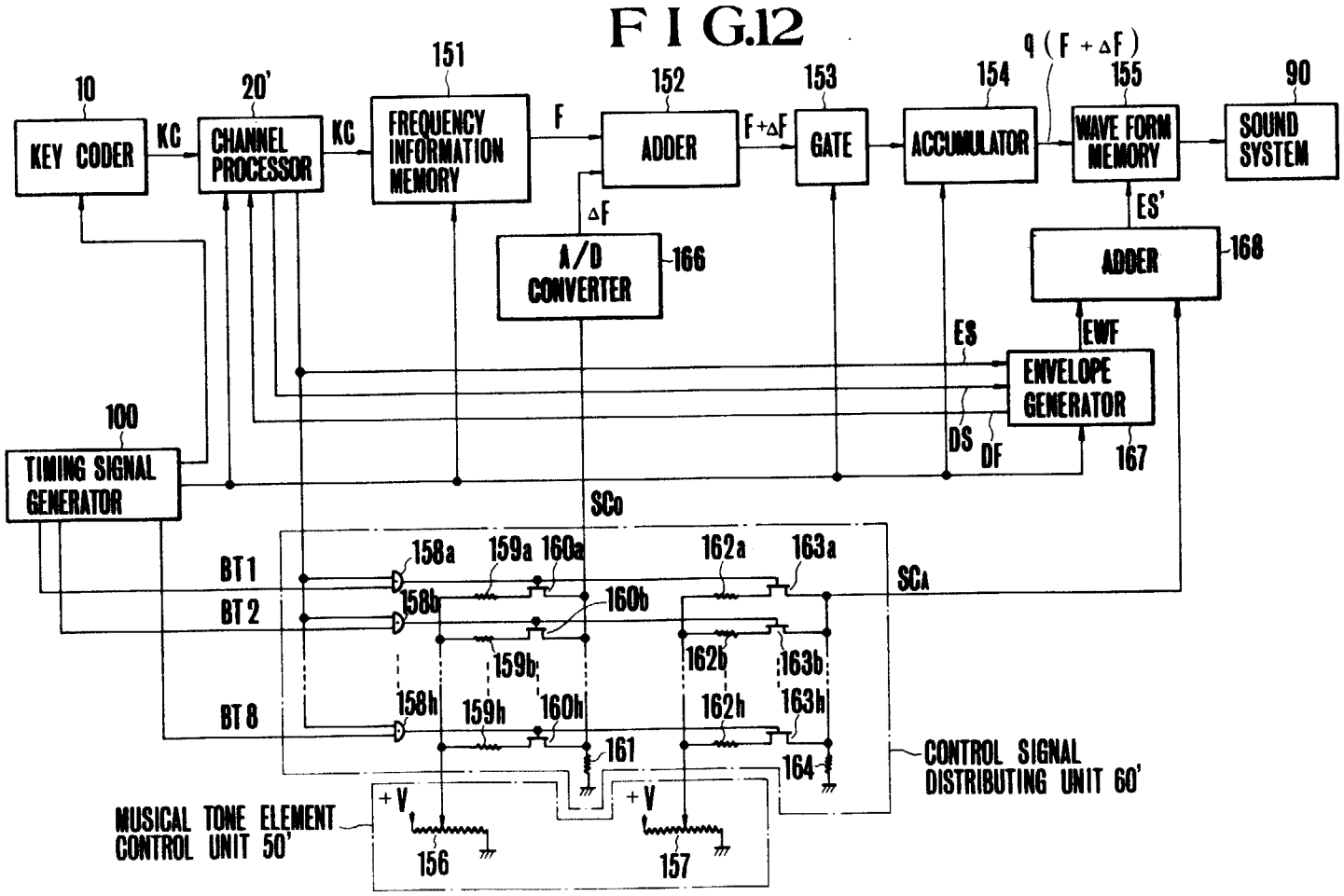
FIG. 12 is a block diagram showing still another embodiment of this invention.

FIG. 12 is a block connection diagram showing still another embodiment of this invention in which the invention is applied to an electronic musical instrument of the waveform read out type. In FIG. 12, circuit components corresponding to those shown in FIG. 1 are designated by the same reference characters. It comprises a channel processor 20', which when the key codes KC sent from the key coder 10 are assigned to idle channels and all channels, assigns a key code to a channel having a key which has been released at the earliest time. The channel processor 20' is different from the channel processor 20 shown in FIG. 1 in that an envelope start signal ES representing an assigned channel, and a decay start signal are sent out on the time sharing basis.

There are also provides a frequency information memory device 151, an adder 152 which adds a signal F read out of the frequency information memory device 151 by designating an address thereof with a key information (code) KC produced by the channel processor 20' to the output $\Delta F$ of an analogue-digital converter 166 for producing an output $F+\Delta F$, a gate circuit 153 connected to the output of the adder 152, an accumulator 154 connected to the output of the gate circuit 153, a waveform memory circuit 155 for storing an amplitude value corresponding to the phase angle of a musical tone waveform and addressed by the output signal $q(F+\Delta F)$ of the accumulator 154, and variable resistors 156 and 157 for controlling the tone pitch and volume respectively of the musical tone elements. Resistor 156 and 157 are connected in series between a source +V and the ground and constitute a musical tone control unit 50'.

AND gate circuits 158a–158h are provided to obtain coincidences between the pulses $BT_1$–$BT_8$ synchronized with the channel times provided by the timing signal generator 100, and an envelope start signal ES supplied by the channel processor 20' for converting serial envelope start signals ES into parallel signals ES. Variable resistors 159a–159h are provided to correspond to respective channels and their first terminals are connected to the output of the variable resistor 156. Resistors 159a–159h have different values.

There are also provided field effect transistors 160a–160h connected between the other terminals of the resistors 158a–158h and a grounded common resistor 161 to be ON-OFF-controlled by the outputs of respective AND gate circuits 158a–158h, and resistors 162a–162h corresponding to respective channels. The first terminals of these resistors are connected to the output terminal of the variable resistor 157. The resistors 162a–162h have different values.

Field effect transistors 163a–163h are connected between the second terminals of resistors 162a–162h and a grounded common resistor 164. The AND gate circuits 158a–158h, the field effect transistors 160a–160h and 163a–163h and resistors associated therewith constitute a control signal distributing unit 60' which produces, on the time sharing basis, the pitch control signal $SC_O$ and the volume control signal $SC_A$ in each channel time.

The modification shown in FIG. 12 further comprises an analogue-digital converter 166 which converts analogue pitch control signals $SC_O$ serially generated in each channel time by the control signal distributing unit 60' into digital signals $\Delta F$ which are supplied to adder 152, an envelope generator 167 which is connected to receive an envelope start signal ES and a decay start signal DS which are sent from the channel processor 20' and a timing signal generated by the timing signal generator 100 for producing, on the time sharing basis, an envelope control waveform signal ES of each channel for the generated musical tone, and an adder 168 which analogously adds the envelope control waveform signal produced by the envelope generator 167 to the volume control signal $SC_A$ generated by the control signal distributing unit 60' for supplying an output signal to the waveform memory circuit 155 to act as an envelope control waveform signal ES'.

When the values of the variable resistors 156 and 157 of the musical element control unit 50' are set to zero, the pitch control signal $SC_O$ and the volume control signal $SC_A$ produced by the control signal distributing unit 60' are also zero. Consequently, the output $\Delta F$ of the analogue-digitals converter 166 is also zero. Consequently, when the variable resistors 156 and 157 are set to produce zero voltages, the musical tone element circuit unit 50' and the control signal distributing unit 60' have no influence upon the outputs of the adder 152 and the waveform memory circuit 155 so that this embodiment operates in the same manner as the conventional electronic musical instrument. More particularly, when the key coder 10 detects the depressed and released states of the keys of the keyboard, it supplies key codes KC representing the depressed keys to the channel processor 20'. Then the channel processor 20' assigns the key codes to channels of the same number as that of the tones to be generated at the same time (in this example, 8). The channel processor 20' is provided with memory positions corresponding to respective channels and store a key code KC representing a key in a memory position corresponding to a channel to which the tone generated by the key has been assigned. The channel processor 20' sequentially produce the key codes KC stored in its memory positions on the time sharing basis. Consequently, when a plurality of keys are depressed simultaneously, the depressed keys are assigned to different channels, and key codes representing the assigned keys are stored in respective memory positions corresponding to the channels. The memory positions may be formed by a circulating type shift register. For example, where the key codes specifying the respective keys of the keyboard are constituted by two bit codes $K_2$ and $K_1$ representing the type of the keyboard, three bit codes $B_3$, $B_2$ and $B_1$ representing the transpositions of octave tones, and four bit codes $N_4$, $N_3$, $N_2$ and $N_1$ representing respective tones in octave, that is a total of 9 bit codes as shown in Table 5, and where the total number of channels is 12, it is possible to use a shift register having 12 stages (1 stage=9 bits).

Table 5

| | | key code KC | | | | | | | | |
|---|---|---|---|---|---|---|---|---|---|---|
| key | | $K_2$, | $K_1$ | $B_3$, | $B_2$, | $B_1$, | $N_4$, | $N_3$, | $N_2$, | $N_1$ |
| | upper | 0 | 1 | | | | | | | |
| keyboard | lower | 1 | 0 | | | | | | | |
| | pedal | 1 | 1 | | | | | | | |
| | first | | | 0 | 0 | 0 | | | | |
| octave range | second | | | 0 | 0 | 0 | | | | |
| | third | | | 0 | 1 | 0 | | | | |
| | fourth | | | 0 | 1 | 1 | | | | |
| | fifth | | | 1 | 0 | 0 | | | | |
| | sixth | | | 1 | 0 | 1 | | | | |
| | C# | | | | | | 0 | 0 | 0 | 0 |
| | D | | | | | | 0 | 0 | 0 | 1 |
| | D# | | | | | | 0 | 0 | 1 | 0 |
| note name | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |

Table 5-continued

| key | key code KC | | | | | | | | |
|---|---|---|---|---|---|---|---|---|---|
| | $K_2$, | $K_1$ | $B_3$, | $B_2$, | $B_1$, | $N_4$, | $N_3$, | $N_2$, | $N_1$ |
| C | | | | | | 1 | 1 | 1 | 0 |

Consequently, key codes representing the keys and assigned to respective tone generating channels by the channel processor 20', that is the key codes KC stored in the shift register are sequentially sent out on the time sharing basis in coincidence with the assigned channel times. Furthermore, the channel processor 20' produces, on the time sharing basis, the envelope start signals ES which represent that musical tones are to be produced by the channels assigned with the depressed keys in synchronism with respective channel times. The channel processor 20' also produces, on the time sharing basis and in synchronism with respective channel times, the decay start signals representing that the keys assigned to the tone generating channels have been released so that the generated tones are decaying. These envelope start signals ES and decay start signals DS are applied to the envelope generator 167 for controlling the amplitude envelope of the musical tone. A decay termination signal DF representing that the tone generation of a specific channel has terminated (decay termination) is sent to the channel processor 20' to clear various memories thereof regulating the specific channel thereby waiting another key depression.

The frequency information memory device 151 is connected to receive key codes KC from the channel processor 20' are producing frequency information values F as shown in Table 6, for example, corresponding to the key codes. In the case shown in Table 6, each values stored in the frequency information memory device 151 comprises 15 bits of which one bit being represented by an integer whereas other 14 bits by decimals. These F values are decimal values obtained by converting bin binary values. The output F of the frequency information memory device is added to the output ΔF of the analogue-digital converter 166 by an adder 166. In the supposed case since the output ΔF is zero, the adder 152 produces the output F itself of the frequency information memory device 151 as its output which is applied to the accumulator 154 via the gate circuit 153 controlled by the clock pulse.

envelope generator 167 is applied to the waveform memory circuit 155.

Consequently, the musical tone waveform read out from the waveform memory circuit 155 is modulated by such waveform as an attack signal, a decay signal, etc. produced by the envelope generator 167 and the musical tone waveform with its envelope controlled in this manner is subjected to a suitable color control in the sound system 90 to form a performance tone. The above description concerns the normal operation wherein the output voltages of the variable resistors 156 and 157 of the musical tone element control unit 50 are set to zero. This operation is the same as that of the electronic musical instrument of the waveform read out type disclosed in U.S. Pat. No. 3,882,751 dated May 13, 1975.

Suppose now that the output voltages of the variable resistors 156 and 157 are set at certain values other than zero by manipulating control members on the operating panel. These set output voltages are applied to one ends of resistors **159*a*–159*h* and 162*a*–162*h*. When pulses $BT_1$–$BT_8$ synchronous with the channel times and generated by the timing signal generator 100 are sequentially supplied to AND gate circuits 158*a*–158*h*, the envelope start signals ES produced by the channel processor 20' synchronously with the assigned channels are distributed among field effect transistors 160*a*–160*h* corresponding to respective channels. As a consequence, the field effect transistors 160*a*–160*h* corresponding to channels to which key codes have been assigned by the channel processor 20' are sequentially turned ON. Thus, the control signal distributing unit 60' produces an output voltage as the pitch control signal $SC_0$ which is obtained by dividing the set voltage of the variable resistor 156 by resistors 159*a*–159*h* selected by the field effect transistors 160*a*–160*h* and the common resistor 161. Since resistors 150*a*–159*h* provided to correspond to respective channels have different values, the pitch control signals $SC_0$ produced by the musical tone signal distributing unit 60'** have differnt values which are predetermined for respective channels. Such Table 6

| note | Interger part $F_{15}$ | Fraction part $F_{14}$ | $F_{13}$ | $F_{12}$ | $F_{11}$ | $F_{10}$ | $F_9$ | $F_8$ | $F_7$ | $F_6$ | $F_5$ | $F_4$ | $F_3$ | $F_2$ | $F_1$ | F value |
|---|---|---|---|---|---|---|---|---|---|---|---|---|---|---|---|---|
| $C_2$ | 0 | 0 | 0 | 0 | 0 | 1 | 1 | 0 | 1 | 0 | 1 | 1 | 0 | 0 | 1 | 0.052325 |
| $C_3$ | 0 | 0 | 0 | 0 | 1 | 1 | 0 | 1 | 0 | 1 | 1 | 0 | 0 | 1 | 0 | 0.104650 |
| $C_4$ | 0 | 0 | 0 | 1 | 1 | 0 | 1 | 0 | 1 | 1 | 0 | 0 | 1 | 0 | 1 | 0.209300 |
| $C_5$ | 0 | 0 | 1 | 1 | 0 | 1 | 0 | 1 | 1 | 0 | 0 | 1 | 0 | 1 | 0 | 0.418600 |
| $C_6$ | 0 | 1 | 1 | 0 | 1 | 0 | 1 | 1 | 0 | 0 | 1 | 0 | 1 | 0 | 0 | 0.837200 |
| $C_6$# | 0 | 1 | 1 | 1 | 1 | 1 | 1 | 1 | 0 | 1 | 1 | 1 | 0 | 0 | 0 | 0.995600 |
| $E_6$ | 1 | 0 | 0 | 0 | 0 | 1 | 1 | 1 | 0 | 0 | 0 | 0 | 0 | 0 | 1 | 1.051808 |
| $C_7$ | 1 | 1 | 0 | 1 | 0 | 1 | 1 | 0 | 0 | 1 | 0 | 1 | 0 | 0 | 1 | 1.674400 |

The accumulator 154 accumulates the value F of each channel and its accumulated value qF is used to address the waveform memory circuitry 155 for sequentially reading out the amplitude of the waveform. To this end, the envelope waveform control signal is applied to the waveform memory circuit 155 from the envelope generator 167 via adder 167. At this time, the volume control signal $SC_A$ supplied to the adder 168 from the control signal distributing unit 60' is zero so that only the envelope waveform control signal ES produced by the pitch control signals are converted into digital signals by the analogue-digital converter 166 and then supplied to the adder 152. The adder adds the frequency information F supplied by the frequency information memory device 151 and corresponding to the depressed key to the digital value ΔF of the pitch control signal $SC_0$ supplied through the analogue-digital converter 166. The sum F+ΔF is applied to the accumulator 154 via the gate circuit 153. At this time, since the input signal to the accumulator 154 is larger than that which is produced when the output voltages of the variable resistors 156 and 157 are set to zero by the sum of the pitch control signal and $\Delta F$ the in integrated output $q(F+\Delta F)$ of the accumulator increases rapidly thus shortening the address access time of the waveform memory circuit 155. Accordingly, the output frequency of the waveform memory circuit 155 storing one period of the musical tone waveform increases with the result that the pitch of the musical tone generated through the sound system 90 varies from channel to channel. As above described, since the key codes KC are randomly assigned to the channels by the channel processor 20' the pitch of the generated musical tone also varies randomly. Moreover, since the output voltage of variable resistors 157 has been set to some value other than zero, like the pitch control signals $SC_0$ described above, volume control signals $SC_A$ corresponding to the set values of resistors **162*a*–162*h* are produced for respective channels to which the key codes KC have been assigned. These volume control signals are analogously added to the envelope waveform control signals ES generated by the envelope generator 107 by adder 168 so as to control the envelope volume of the musical tone signals read out from the waveform memory circuit 155 by the output of the adder 168, thereby increasing the volume of the generated musical tone. In this case too, since the key codes are randomly assigned to channels by the channel processor 20' and since the values of resistors 162*a* through 162*h*** are made different so as to make different the values of the volume control signals for different channels, the volume of the generated musical tone also has random property thus readily rendering rich the performed musical tones.

It should be understood that the invention is not limited to the specific embodiments described above and that many changes and modifications can be made without departing from spirit of the invention.

Thus for example, FIG. 13 illustrates a modification of the musical element control signal generating unit 50 shown in FIGS. 1, 7A and 7B. In the embodiment shown in FIGS. 7A and 7B, a single variable resistor, for example **51*a*, was used for forming first and second control signals $SC_{10}$ and $SC_{20}$ for a musical element (pitch). For this reason, two comparators 53 and 54 were used to produce control signals having opposite polarities. In the modification shown in FIG. 13, however, two independent variable resistors 161*a* and 162*a* are connected to sources of opposite polarities +V and −V so as to produce control signals $SC_{10}$ and $SC_{20}$ of the opposite polarity. Thus, the construction of this musical tone element control unit 50''** is simpler than that shown in FIGS. 7A and 7B.

Although, in the foregoing embodiments two groups or series of musical tone forming units were shown, the number of such groups may be one, three or more. Furthermore, the construction of the musical tone forming unit is not limited to the illustrated synthesizer system utilizing VCO, VCF and VCA. In the foregoing embodiments, the musical tone element control signals were applied to VCO, VCF and VCA for the purpose of variably controlling the musical elements of the musical signals formed by the musical tone forming unit, but the musical tone element control signals may be applied to an envelope generator or other function circuits (not shown) of the musical tone forming unit.

What is claimed is:

1. In an electronic musical instrument of the type comprising a keyboard having a plurality of keys; a plurality of musical tone generating channels each for producing a musical tone having pitch, tone color and envelope elements, the number of said channels being less than that of said keys; a circuit for generating key codes that identify depressed keys of said keyboard; a channel assigner circuit for assigning, in a substantially irregular manner, each of said key codes to a channel ready for receiving them; and means for generating, in response to each of said key codes, a first signal for designating the pitch of musical tones to be generated, and a second signal for determining the timing of the generation of said musical tones; the improvement which comprises musical tone element control means for producing a musical tone element control signal which modifies at least one of said pitch, tone color, and envelope of the musical tone generated by at least one channel differently from the pitch, tone color, and envelope of the musical tone generated by another channel.

2. An electronic musical instrument according to claim 1 wherein said musical tone element control means comprises musical tone element control signal generating means for supplying a musical tone element control signal to said musical tone generating channels, distributing means for distributing said musical tone element control signal among said musical tone generating channels and means for varying the musical tone element control signal supplied to one channel differently from that supplied to another channel.

3. An electronic musical instrument according to claim 2 which further comprises manually operated means mounted on a panel of said musical instrument for controlling said musical tone element control signal generating means.

4. An electronic musical instrument according to claim 2 which further comprises a control member actuated by a foot of a player for controlling said musical tone element control signal generating means.

5. An electronic musical instrument according to claim 1 wherein said first signal for designating the pitch of the musical tone to be generated comprises a voltage signal decisive of said pitch, and said musical tone element control signal comprises a direct current voltage singal which is applied to voltage controlled oscillators contained in the musical tone generating channels for varying the pitch of the generated musical tone.

6. An electronic musical instrument according to claim 1 wherein each of said musical tone generating channels comprises a voltage controlled variable frequency oscillator, a voltage controlled variable filter, and a voltage controlled variable gain amplifier, and wherein said first signal for designating the pitch of a musical tone to be generated comprises a voltage signal decisive of said pitch and said musical tone element control signal comprises a direct current voltage signal which is supplied to said variable frequency oscillator, said variable filter and said variable gain amplifier for modifying the pitch, tone color and envelope of the musical tone.

7. An electronic musical instrument according to claim 1 wherein said first signal comprises a numerical signal proportional to a frequency and said channels are operated on a time sharing basis, and wherein said electronic musical instrument further comprises an accumulator that accumulates said numerical signal and a waveform memory circuit connected to receive the output of said accumulator for storing an amplitude value corresponding to a phase angle of the waveform of the musical tone, the phase angle being designated by the output of said accumulator; and an envelope generator producing an envelope waveform in accordance with said second signal that determines the timing of generating the musical tone, said envelope waveform modulating the amplitude value of the waveform memory to be read out in response thereto, and said musical tone element control signal modifying said numerical signal.

8. An electronic musical instrument according to claim 1 wherein each of said musical tone generating channels comprises two sets of tone forming circuits for simultaneously generating the same key information by different tone forming circuits, and wherein said musical tone element control signal is made to be different for respective tone generating channels.

9. An electronic musical instrument according to claim 8 wherein said two sets of tone forming circuits of a musical tone generating channel are controlled by said musical element control signal and by a signal produced by inverting said musical element control signal.

10. An electronic musical instrument according to claim 8 wherein said musical tone element control signals applied to said two sets of tone generating circuits are produced by two independent variable resistors which are connected to direct current sources having opposite polarities.

11. An electronic musical instrument according to claim 1 wherein said musical tone element control means comprises means for detecting a plurality of keys of said keyboard which are depressed simultaneously for producing a plural depressed key detection signal and means for applying said modifying signal to said musical tone generating channels when said detection signal is produced.

* * * * *